US012618580B2

(12) United States Patent
Cao

(10) Patent No.: US 12,618,580 B2
(45) Date of Patent: May 5, 2026

(54) METHOD FOR CONTROLLING AIR CONDITIONING SYSTEM AND AIR CONDITIONING SYSTEM

(71) Applicant: QINGDAO HISENSE HITACHI AIR-CONDITIONING SYSTEMS CO., LTD., Qingdao (CN)

(72) Inventor: Xiuxia Cao, Qingdao (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 496 days.

(21) Appl. No.: 18/355,237

(22) Filed: Jul. 19, 2023

(65) Prior Publication Data

US 2023/0366577 A1 Nov. 16, 2023

Related U.S. Application Data

(63) Continuation of application No. PCT/CN2022/114590, filed on Aug. 24, 2022.

(30) Foreign Application Priority Data

Aug. 24, 2021 (CN) ..... 202110975548.8
Aug. 24, 2021 (CN) ..... 202110976259.X
Sep. 27, 2021 (CN) ..... 202111136870.8

(51) Int. Cl.
*F24F 11/58* (2018.01)
*F24F 11/54* (2018.01)

(52) U.S. Cl.
CPC ..... *F24F 11/54* (2018.01); *F24F 11/58* (2018.01)

(58) Field of Classification Search
CPC ..... F24F 11/54; F24F 11/58
See application file for complete search history.

(56) References Cited

U.S. PATENT DOCUMENTS

2012/0191255 A1* 7/2012 Han ..... F24F 11/63 714/E11.023
2013/0060386 A1* 3/2013 Cha ..... F24F 11/61 700/278

(Continued)

FOREIGN PATENT DOCUMENTS

CN 1889481 A 1/2007
CN 102322672 A 1/2012

(Continued)

OTHER PUBLICATIONS

International Search Report and Written Opinion dated May 19, 2022 in corresponding International Application No. PCT/CN2021/122017, translated, 13 pages.

(Continued)

*Primary Examiner* — Mohammad Ali
*Assistant Examiner* — Vincent W Chang
(74) *Attorney, Agent, or Firm* — MH2 TECNOLOGY LAW GROUP LLP

(57) ABSTRACT

An air conditioning system includes a plurality of indoor units, a plurality of outdoor units, a gateway device, a server and a terminal device. A method for controlling the air conditioning system includes: the gateway device obtaining first category identification information of an outdoor unit and second category identification information of an indoor unit coupled to the outdoor unit, and sending the first category identification information and the second category identification information to the server; the server determining a piece of scenario data corresponding to the outdoor unit and the indoor unit according to the first category identification information, the second category identification information and a scenario data table, and outputting the piece of scenario data to the terminal device; and the (Continued)

terminal device outputting at least one scenario corresponding to the piece of scenario data.

20 Claims, 5 Drawing Sheets

(56) References Cited

U.S. PATENT DOCUMENTS

| | | | | |
|---|---|---|---|---|
| 2016/0084551 | A1* | 3/2016 | Hur | F24F 11/62 62/160 |
| 2016/0223215 | A1 | 8/2016 | Buda et al. | |
| 2019/0212026 | A1* | 7/2019 | Kim | G05B 13/048 |
| 2020/0041151 | A1* | 2/2020 | Tatei | F24F 11/56 |
| 2020/0284461 | A1* | 9/2020 | Jiao | F24F 11/64 |
| 2020/0400331 | A1* | 12/2020 | Hanai | H04L 12/413 |
| 2021/0140669 | A1* | 5/2021 | Wang | F24F 11/56 |
| 2023/0021634 | A1 | 1/2023 | He et al. | |

FOREIGN PATENT DOCUMENTS

| | | | |
|---|---|---|---|
| CN | 103383128 | A | 11/2013 |
| CN | 103438551 | A | 12/2013 |
| CN | 103615789 | A | 3/2014 |
| CN | 105066381 | A | 11/2015 |
| CN | 105207863 | A | 12/2015 |
| CN | 105897755 | A | 8/2016 |
| CN | 106453011 | A | 2/2017 |
| CN | 108036475 | A | 5/2018 |
| CN | 108592349 | A | 9/2018 |
| CN | 208475566 | U | 2/2019 |
| CN | 109724206 | A | 5/2019 |
| CN | 109764483 | A | 5/2019 |
| CN | 109936489 | A | 6/2019 |
| CN | 110108002 | A | 8/2019 |
| CN | 110489147 | A | 11/2019 |
| CN | 111322725 | A | 6/2020 |
| CN | 111397174 | A | 7/2020 |
| CN | 112146236 | A | 12/2020 |
| CN | 112305927 | A | 2/2021 |
| CN | 112416384 | A | 2/2021 |
| CN | 112665101 | A | 4/2021 |
| CN | 112682916 | A | 4/2021 |
| CN | 113254038 | A | 8/2021 |
| CN | 113339956 | A | 9/2021 |
| CN | 113701250 | A | 11/2021 |
| CN | 113701314 | A | 11/2021 |
| CN | 113865024 | A | 12/2021 |
| EP | 3640555 | A1 | 4/2020 |
| JP | 2002349940 | A | 12/2002 |
| JP | 2015055447 | A | 3/2015 |
| JP | 2020153646 | A | 9/2020 |
| KR | 20060119297 | A | 11/2006 |

OTHER PUBLICATIONS

International Search Report and Written Opinion dated Nov. 24, 2022 in corresponding International Application No. PCT/CN2022/114590, translated, 19 pages.

Chinese First Office Action dated May 17, 2022 in corresponding Chinese Application No. 202110975548.8, translated, 13 pages.

Chinese Notification of Grant of Invention Patent Rights dated Nov. 28, 2022 in corresponding Chinese Application No. 202110975548.8, translated, 6 pages.

Chinese Notification of the First Office Action dated May 18, 2022 in corresponding Chinese Application No. 202110976259.X, translated, 14 pages.

Chinese First Office Action dated Aug. 17, 2022 in corresponding Chinese Application No. 202111136870.8, translated, 17 pages.

* cited by examiner

METHOD FOR CONTROLLING AIR CONDITIONING SYSTEM AND AIR CONDITIONING SYSTEM

CROSS-REFERENCE TO RELATED APPLICATIONS

This application is a continuation application of International Patent Application No. PCT/CN2022/114590, filed on Aug. 24, 2022, which claims priority to Chinese Patent Application No. 202110975548.8, filed on Aug. 24, 2021, and Chinese Patent Application No. 202110976259.X, filed on Aug. 24, 2021, and Chinese Patent Application No. 202111136870.8, filed on Sep. 27, 2021, which are incorporated herein by reference in their entireties.

TECHNICAL FIELD

The present disclosure relates to the technical field of air conditioning, and in particular, to a method for controlling an air conditioning system and an air conditioning system.

BACKGROUND

With intelligent development of home appliance systems, it has become a trend to use a terminal device to control home appliances. For example, operations of the home appliances such as the air conditioner can be controlled through an application (APP) installed on the terminal device.

SUMMARY

In an aspect, a method for controlling an air conditioning system is provided. The air conditioning system includes a plurality of indoor units, a plurality of outdoor units, a gateway device, a server, and a terminal device. The gateway device is configured to obtain first category identification information of an outdoor unit and second category identification information of an indoor unit coupled to the outdoor unit and send the first category identification information and the second category identification information to the server. The server is configured to determine a piece of scenario data corresponding to the indoor unit and the outdoor unit according to the first category identification information, the second category identification information, and a scenario data table, and output the piece of scenario data to the terminal device. The terminal device is configured to output at least one scenario corresponding to the piece of scenario data. The method includes an information collecting step, an information transmitting step, an information determining step, and an information outputting step. The information collecting step is configured to obtain, by the gateway device, the first category identification information of the outdoor unit and the second category identification information of the indoor unit coupled to the outdoor unit. The information transmitting step is configured to send, by the gateway device, the first category identification information and the second category identification information to the server. The information determining step is configured to determine, by the server, the piece of scenario data corresponding to the outdoor unit and the indoor unit according to the first category identification information, the second category identification information and the scenario data table. The scenario data table includes a plurality of pieces of scenario data corresponding to the plurality of indoor units and the plurality of outdoor units, and each piece of scenario data corresponds to at least one scenario. The information outputting step is configured to output, by the server, the piece of scenario data to the terminal device, and output, by the terminal device, at least one scenario corresponding to the piece of scenario data.

In another aspect, a non-transitory computer-readable storage medium is provided. The non-transitory computer-readable storage medium has stored thereon computer program instructions that, when executed by an air conditioning system, cause the air conditioning system to perform the method for controlling the air conditioning system.

In yet another aspect, an air conditioning system is provided. The air conditioning system includes a plurality of indoor units, a plurality of outdoor units, a gateway device, a server, and a terminal device. Each outdoor unit in the plurality of outdoor units is coupled to at least one indoor unit in the plurality of indoor units. The gateway device is coupled to the plurality of outdoor units and the plurality of indoor units and is configured to obtain first category identification information of each outdoor unit and second category identification information of each indoor unit and send the first category identification information and the second category identification information to the server. The server is coupled to the gateway device and configured to generate a scenario data table according to the first category identification information and the second category identification information and store the scenario data table. The scenario data table includes a plurality of pieces of scenario data corresponding to the plurality of indoor units and the plurality of outdoor units, and each piece of scenario data corresponds to at least one scenario. The terminal device is coupled to the server and configured to obtain a piece of scenario data and output at least one scenario corresponding to the piece of scenario data.

DETAILED DESCRIPTION

Figure 1A:
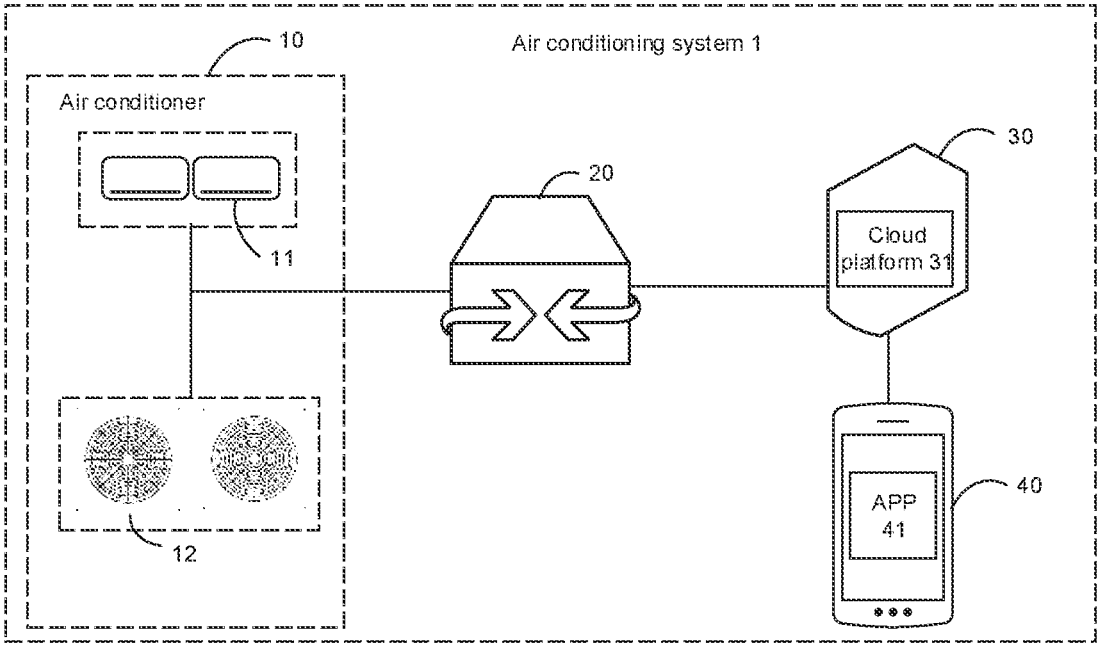
FIG. 1A is a schematic diagram of an air conditioning system, in accordance with some embodiments.

The technical solutions in some embodiments of the present disclosure will be described clearly and completely with reference to the accompanying drawings below. Obviously, the described embodiments are merely some but not all of embodiments of the present disclosure. All other embodiments obtained on a basis of the embodiments of the present disclosure by a person of ordinary skill in the art shall be included in the protection scope of the present disclosure.

Unless the context requires otherwise, throughout the specification and claims, the term "comprise" and other forms thereof such as the third-person singular form "comprises" and the present participle form "comprising" are construed as an open and inclusive meaning, i.e., "including, but not limited to."

In the description of the specification, the terms such as "one embodiment," "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics described herein may be included in any one or more embodiments or examples in any suitable manner.

Hereinafter, the terms "first" and "second" are only used for descriptive purposes and cannot be construed as indicating or implying the relative importance or implicitly indicating the number of indicated technical features. Thus, features defined with "first" or "second" may explicitly or implicitly include one or more of the features. In the description of the embodiments of the present disclosure, terms "a plurality of," "the plurality of," and "multiple" each mean two or more unless otherwise specified.

In the description of some embodiments, the expressions "coupled" and "connected" and derivatives thereof may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other but still cooperate or interact with each other. The embodiments disclosed herein are not necessarily limited to the content herein.

The phrase "at least one of A, B, and C" has the same meaning as the phrase "at least one of A, B, or C", and they both include the following combinations of A, B, and C: only A, only B, only C, a combination of A and B, a combination of A and C, a combination of B and C, and a combination of A, B, and C.

The phrase "A and/or B" includes the following three combinations: only A, only B, and a combination of A and B.

As used herein, depending on the context, the term "if" is optionally construed as "when" or "in a case where" or "in response to determining" or "in response to detecting". Similarly, depending on the context, the phrase "if it is determined" or "if [a stated condition or event] is detected" is optionally construed as "in a case where it is determined," "in response to determining," "in a case where [the stated condition or event] is detected," or "in response to detecting [the stated condition or event]".

The phase "applicable to" or "configured to" as used herein means an open and inclusive language, which does not exclude apparatuses that are applicable to or configured to perform additional tasks or steps.

In addition, the use of the phrase "based on" is meant to be open and inclusive, since a process, step, calculation, or other action that is "based on" one or more of the stated conditions or values may, in practice, be based on additional conditions or values exceeding those stated.

With an increasing variety of outdoor unit models and indoor unit models of central air conditioners, each model has an increasing difference therebetween. In a case where an outdoor unit in a central air conditioner is matched with different indoor units, the central air conditioner may be provided with a plurality of scenarios. For example, the plurality of scenarios may include a health scenario, a night silence scenario, a fast cooling/heating scenario, and the like.

It can be understood that different scenarios require different air conditioning parameters. Therefore, parameters of the indoor unit and the outdoor unit need to be adjusted according to different scenarios, so as to implement the effect desired by the user. For example, the parameters of the indoor unit and the outdoor unit include but are not limited to temperature, humidity, wind speed, and noise.

In a case where the indoor air quality is poor (e.g., the user moves into a new house), the health scenario of the central air conditioner may be turned on. In the health scenario, the central air conditioner turns off a compressor to stop cooling or heating, turns on a purification device to kill bacteria and viruses in the air, and increases a rotational speed of a fan to accelerate the air exchange between an indoor environment and an outdoor environment.

In a case where the user needs to sleep, the night silence scenario may be turned on. In the night silence scenario, the central air conditioner may reduce an operating frequency of the compressor and the rotational speed of the fan, so as to reduce noise and vibration of the operation of the central air conditioner and reduce the efficiency of cooling or heating, thereby satisfying the needs of the user at night.

In a case where indoor space is large, it is necessary to quickly adjust the air temperature in the indoor environment, and the fast cooling/heating scenario of the central air conditioner may be turned on. In the fast cooling/heating scenario, the central air conditioner increases the frequency of the compressor to the maximum and the rotational speed of the fan to the maximum, so as to improve cooling and heating efficiency.

Generally, the user may view the scenarios provided by the central air conditioner through an application (APP) on the terminal device. However, the APP on the terminal device may only determine available scenarios (e.g., the night silence scenario) according to existing models and parameters of outdoor units. With the increasing functional differences of the outdoor unit models and the indoor unit models of the central air conditioners and the increasing number of the models, it is difficult for the APP on the terminal device to adapt and show new scenarios.

Some embodiments of the present disclosure provide an air conditioning system. For example, the air conditioning system may be a central air conditioning system. As shown in FIG. 1A, the air conditioning system 1 includes an air conditioner 10, a gateway device 20, a server 30, and a terminal device 40. The air conditioner 10 includes a plurality of indoor units 11 and a plurality of outdoor units 12 (only two outdoor units are shown in FIG. 1A).

Each outdoor unit 12 is coupled to at least one indoor unit 11. In some examples, the outdoor unit 12 and the indoor unit 11 may be connected by a communication bus.

For example, the gateway device 20 may include a communication device, and the communication device may enable the gateway device 20 to communicate using Narrow Band Internet of Things (NB-IoT) or wireless network communication technologies (e.g., Wi-Fi). As shown in FIG. 1A, the gateway device 20 may be coupled to the plurality of indoor units 11 and the plurality of outdoor units 12.

As shown in FIG. 1A, the gateway device 20 is further coupled to the server 30. The server 30 may be, for example, a cloud server. For example, the server 30 may include a cloud platform 31. The cloud platform 31 implements interaction with each indoor unit 11 and each outdoor unit 12 through the gateway device 20. The cloud platform 31 may be a service cloud platform for processing service data related to functions of the terminal device 40.

For example, the gateway device 20 may obtain respective operating information of the indoor unit 11 and the outdoor unit 12 and transmit the respective operating information of the indoor unit 11 and the outdoor unit 12 to the cloud platform 31. The operating information of the indoor unit 11 may include equipment information and working state information (including one or more working states of the indoor unit 11) of the indoor unit 11, and the operating information of the outdoor unit 12 includes equipment information and working state information (including one or more working states of the outdoor unit 12) of the outdoor unit 12.

In some examples, the gateway device 20 may be an NB-IoT adapter configured on the outdoor unit 12. For example, the NB-IoT adapter may be disposed inside the outdoor unit 12. For example, the NB-IoT adapter includes a main control chip and a communication chip connected to the main control chip. The main control chip is used to obtain the operating information of the indoor unit 11 and the outdoor unit 12 and transmit the operating information of the indoor unit 11 and the outdoor unit 12 to the communication chip. The communication chip receives the operating information of the indoor unit 11 and the outdoor unit 12 and reports them to the cloud platform 31.

In some other examples, the gateway device 20 may be a Wi-Fi gateway, and the Wi-Fi gateway may be connected to the communication bus (i.e., a line connecting devices in the air conditioning system 1). The Wi-Fi gateway may report the operating information of the indoor unit 11 and the outdoor unit 12 in the air conditioning system 1 to the cloud platform 31.

For example, the terminal device 40 may be a mobile phone, a computer, a wearable device (e.g., a watch), and the like. The terminal device 40 may be installed with an application (APP) 41 for controlling IoT home appliances (e.g., the air conditioning system 1), and the user may control operating states of the devices (e.g., the air conditioner 10) in the IoT home appliances through the APP 41.

Figure 3:
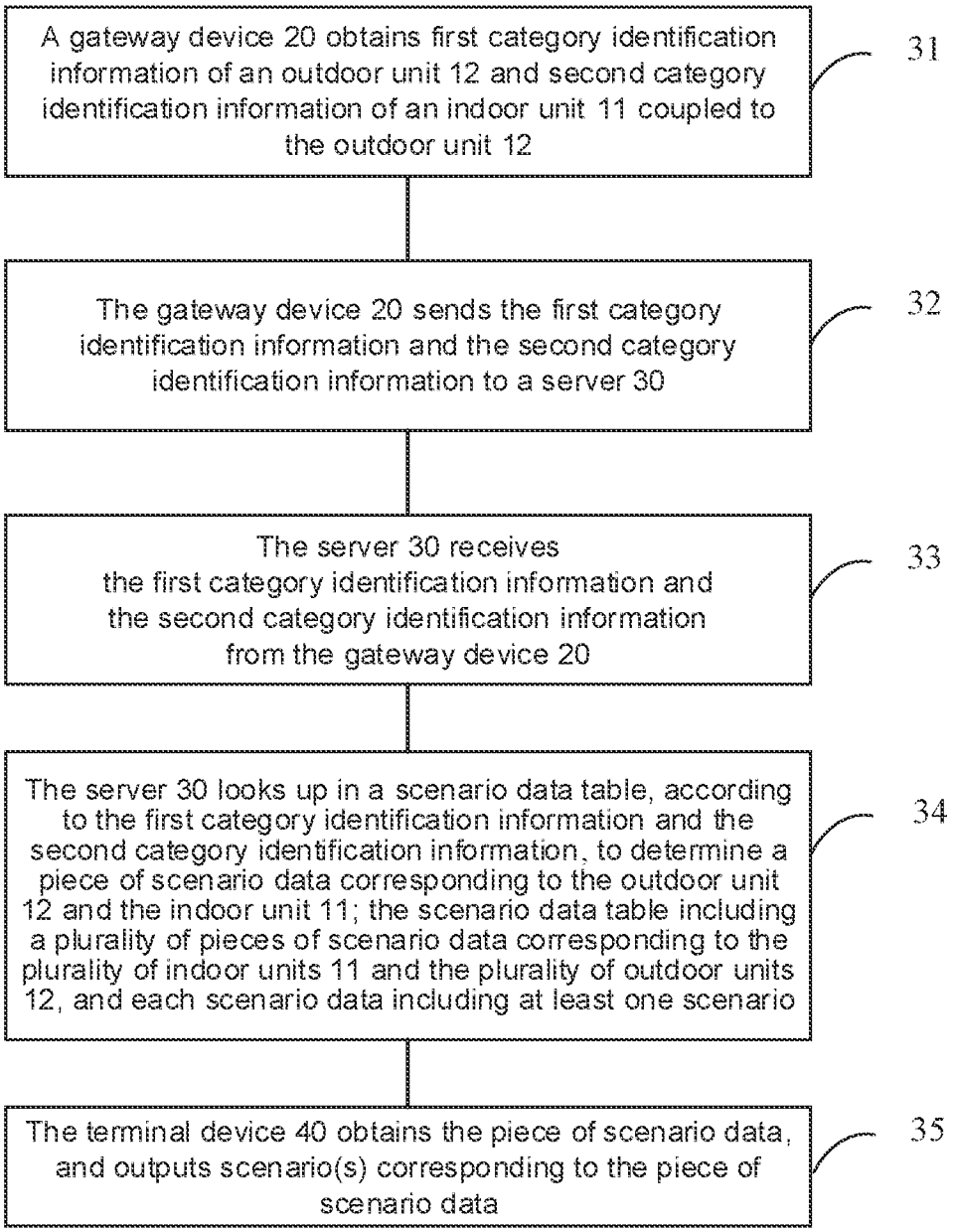
FIG. 3 is a flow diagram of a method for controlling an air conditioning system, in accordance with some embodiments.

FIG. 3 is a flow diagram of a method for controlling an air conditioning system, in accordance with some embodiments. The method includes steps 31 to 35.

In step 31, the gateway device 20 obtains first category identification information of an outdoor unit 12 and second category identification information of an indoor unit 11 coupled to the outdoor unit 12.

In step 32, the gateway device 20 sends the first category identification information and the second category identification information to the server 30.

The respective operating information of the indoor unit 11 and the outdoor unit 12 obtained by the gateway device 20 further includes the first category identification information of the outdoor unit 12 and the second category identification information of the indoor unit 11.

For example, the first category identification information is used to identify a category of the outdoor unit 12, and the second category identification information is used to identify a category of the indoor unit 11. For example, the first category identification information may be an outdoor unit model code, and the second category identification information may be an indoor unit model code, and the categories of the indoor unit and the outdoor unit may be identified according to the indoor unit model code and the outdoor unit model code.

In some examples, a dial switch may be used to set the indoor unit model code and the outdoor unit model code. For example, the dial switch may be disposed on a base plate of the outdoor unit 12, and the outdoor unit model code of the outdoor unit 12 may be set by the dial switch. For example, the dial switch may set an outdoor unit model code of a side air exhaust type outdoor unit to 0x01, set an outdoor unit model code of a wall-mounted outdoor unit to 0x02, set an outdoor unit model code of a water-cooled outdoor unit to 0x03, and set an outdoor unit model code of a multi-connected outdoor unit to 0x04, etc.

It will be noted that the outdoor unit model code is an identification of the outdoor unit and is used to distinguish different categories or models of outdoor units. The outdoor unit model code is usually assigned to the outdoor unit when the outdoor unit is designed and produced.

Since different categories of outdoor units and different categories of indoor units have different functions, different outdoor unit model codes and different indoor unit model codes represent different functions. Therefore, functions of indoor units and outdoor units may be determined respectively according to the indoor unit model codes and the outdoor unit model codes. For example, the outdoor units may be divided into different categories according to the outdoor unit model codes. Each category of outdoor unit may have a different function. Some outdoor units may have functions such as turning on, turning off, and cooling, while some other outdoor units may have functions such as turning on, turning off, heating, and air supplying.

For example, in a case where different indoor unit model codes are matched with different outdoor unit model codes, since each indoor unit and each outdoor unit have different functions, the corresponding scenarios may be different. For example, in a case where both an outdoor unit and an indoor unit have the heating function, the indoor unit and the outdoor unit may be matched together to correspond to a first scenario. In the first scenario, the air conditioning system may raise an ambient temperature to a preset first target temperature within a predetermined time, so as to achieve heating. The first scenario may also be referred to as a one-click heating scenario. Therefore, the scenario(s) corresponding to the indoor unit and the outdoor unit may be determined according to the indoor unit model code and the outdoor unit model code.

It will be noted that the scenarios involved in some embodiments of the present disclosure refer to application scenarios customized by combining the functions of the air conditioner 10 with factors such as space, time, and season. The scenarios may include, for example, the first scenario where the ambient temperature is raised to the first target temperature within the preset time, and a second scenario where the ambient temperature is lowered to a second target temperature within a preset time, and the like.

Figure 2:
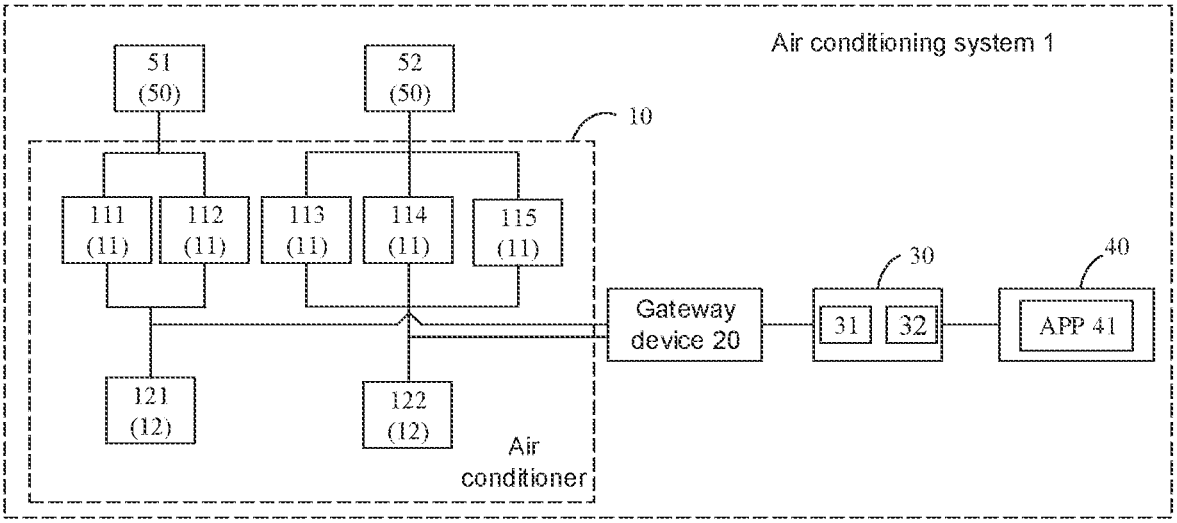
FIG. 2 is a block diagram of yet another air conditioning system, in accordance with some embodiments.

For example, referring to FIG. 2, in a case where an outdoor unit model code of an outdoor unit 122 is 0x06, and indoor unit model codes of an indoor unit 113, an indoor unit 114 and an indoor unit 115 are respectively 0x1E, 0x2E, and 0x2F, if the indoor unit 113, the indoor unit 114, and the indoor unit 115 all have the heating mode, the scenarios corresponding to the air conditioner 10 include the first scenario.

For another example, in a case where an outdoor unit model code of an outdoor unit 121 is 0x06, and an indoor unit model code of an indoor unit 111 is 0x1E, if the indoor unit 111 has the cooling mode, the scenarios corresponding to the air conditioner 10 include the second scenario.

For yet another example, in a case where an outdoor unit model code of an outdoor unit 121 is 0x17, and indoor unit model codes of the indoor unit 111 and an indoor unit 112 are respectively 0x1E and 0x2D, if the indoor unit 111 and the indoor unit 112 both have the night silence mode, the scenarios corresponding to the air conditioner 10 include a third scenario.

The gateway device 20 may obtain the first category identification information of the outdoor unit 12 coupled to the gateway device 20 and the second category identification information of the indoor unit 11 coupled to the gateway device 20 and send the first category identification information and the second category identification information to the server 30 (e.g., to the cloud platform 31).

In step 33, the server 30 receives the first category identification information and the second category identification information sent by the gateway device 20.

In step 34, the server 30 looks up in a scenario data table, according to the first category identification information and the second category identification information, to determine a piece of scenario data corresponding to the outdoor unit 12 and the indoor unit 11. The scenario data table includes a plurality of pieces of scenario data corresponding to the plurality of indoor units 11 and the plurality of outdoor units 12, and each piece of scenario data corresponds to at least one scenario.

After the server 30 (e.g., the cloud platform 31) obtains the first category identification information and the second category identification information, the scenario(s) corresponding to the outdoor unit 12 and the indoor unit 11 may be obtained by looking up in the scenario data table.

The scenario data table may be generated according to first category identification information of the plurality of outdoor units 12 and second category identification information of the plurality of indoor units 11. For example, the server 30 may generate the scenario data table according to a plurality of outdoor unit model codes and a plurality of indoor unit model codes. A process of generating the scenario data table will be illustrated below by considering an example where the first category identification information is the outdoor unit model code and the second category identification information is the indoor unit model code.

For example, the scenario data table includes but is not limited to the plurality of pieces of scenario data corresponding to indoor units with the plurality of indoor unit model codes and outdoor units with the plurality of outdoor model codes. Each indoor unit model code and an outdoor unit model code correspond to a piece of scenario data, and each outdoor unit model code and an indoor unit model code correspond to a piece of scenario data.

In some examples, the server 30 may generate the scenario data table according to each indoor unit model code, each outdoor unit model code, and scenarios corresponding to each indoor unit model code and an outdoor unit model code, and scenarios corresponding to each outdoor unit model code and an indoor unit model code. It will be noted that each indoor unit model code and each outdoor unit model code mentioned here respectively refer to all indoor unit model codes and all outdoor unit model codes, which are not limited to the indoor unit model codes corresponding to the plurality of indoor units 11 (e.g., the indoor unit 111 to the indoor unit 115) in the air conditioning system 1 and the outdoor unit model codes corresponding to the plurality of outdoor units 12 (e.g., the outdoor unit 121 and the outdoor unit 122) in the air conditioning system 1. Each indoor unit model code and an outdoor unit model code correspond to at least one scenario, and each outdoor unit model code and an indoor unit model code correspond to at least one scenario.

For example, the scenario data table may be shown in Table 1 below. In Table 1, a first row lists a plurality of different indoor unit model codes, and a first column lists a plurality of different outdoor unit model codes. Each indoor unit model code and an outdoor unit model code correspond to a piece of scenario data, each outdoor unit model code and an indoor unit model code correspond to a piece of scenario data, and each piece of scenario data corresponds to at least one scenario $M_x$, where x is an integer greater than or equal to 1 (i.e., $x \geq 1$). A scenario $M_1$ may represent the first scenario, and a scenario $M_2$ may represent the second scenario. For example, as shown in Table 1, a piece of scenario data corresponding to an indoor unit model code 0x1E and an outdoor unit model code 0x06 is "$M_1$, $M_2$," indicating that the piece of scenario data corresponding to the indoor unit model code 0x1E and the outdoor unit model code 0x06 includes the scenario $M_1$ and the scenario $M_2$.

TABLE 1

| | 0x1E | 0x2E | 0x2F | 0x2D | ... |
|---|---|---|---|---|---|
| 0x06 | $M_1$, $M_2$ | $M_1$, $M_3$ | $M_1$, $M_4$ | $M_2$, $M_4$ | ... |
| 0x07 | $M_1$, $M_2$ | $M_1$, $M_3$ | $M_1$, $M_4$ | $M_2$, $M_4$ | ... |
| 0x16 | $M_1$, $M_6$ | $M_1$, $M_2$, $M_9$ | $M_1$, $M_5$ | $M_1$, $M_6$ | ... |
| 0x17 | $M_1$, $M_6$ | $M_1$, $M_2$, $M_9$ | $M_1$, $M_5$ | $M_1$, $M_6$ | ... |
| ... | ... | ... | ... | ... | ... |

For example, all scenario data in the scenario data table may compose a scenario matrix $A_{mn}$, where m is greater than or equal to 1 (i.e., $m \geq 1$), n is greater than or equal to 1 (i.e., $n \geq 1$), and both m and n are integers. Here, m is determined by the number of outdoor unit model codes, and n is determined by the number of indoor unit model codes. Each piece of scenario data in the scenario matrix $A_{mn}$ may be expressed as Bi, where i is greater than or equal to 1 and less than or equal to m (i.e., $1 \leq i \leq m$), j is greater than or equal to 1 and less than or equal to n (i.e., $1 \leq j \leq n$), and both i and j are integers.

For example, in a case where the number of the indoor unit model codes and the number of the outdoor unit model codes are both four, pieces of scenario data corresponding to all the indoor unit model codes and all the outdoor unit model codes in the four indoor unit model codes and the four outdoor unit model codes compose a scenario matrix $A_{44}$, and the scenario matrix $A_{44}$ includes sixteen pieces of scenario data $B_{ij}$. For example, a piece of scenario data $B_{11}$ represents a piece of scenario data corresponding to a first indoor unit model code 0x1E and a first outdoor unit model code 0x06 and includes the scenarios $M_1$ and $M_2$. A piece of scenario data $B_{44}$ represents a piece of scenario data corresponding to a fourth indoor unit model code 0x2D and a fourth outdoor unit model code 0x17 and includes scenarios $M_1$ and Me.

For example, the server 30 (e.g., the cloud platform 31) may store the generated scenario data table. After the server 30 obtains the indoor unit model code of the indoor unit 11 of the air conditioner 10 and the outdoor unit model code of the outdoor unit 12 of the air conditioner 10, the scenarios corresponding to the outdoor unit 12 and the indoor unit 11 coupled to the outdoor unit 12 may be looked up in the stored scenario data table (as shown in Table 1).

A process of looking up in the scenario data table will be illustrated in the following embodiments by considering the cloud platform 31 in the server 30 as an example.

For example, in a case where the cloud platform 31 obtains the outdoor unit model code 0x06 of the outdoor unit 121 and the indoor unit model code 0x1E of the indoor unit 111 coupled to the outdoor unit 121, the cloud platform 31 looks up a piece of scenario data corresponding to the outdoor unit model code 0x06 and the indoor unit model code 0x1E in the scenario data table. For example, the piece of scenario data $B_{11}$ corresponding to the outdoor unit model code 0x06 and the indoor unit model code 0x1E will be looked up in Table 1, and the piece of scenario data $B_{11}$ is "$M_1$, $M_2$". That is, the piece of scenario data $B_{11}$ includes the scenario $M_1$ and the scenario $M_2$. Therefore, the scenarios corresponding to the outdoor unit 121 and the indoor unit 111 coupled to the outdoor unit 121 include the scenario $M_1$ and the scenario $M_2$.

For another example, in a case where the cloud platform 31 obtains the outdoor unit model code 0x16 of the outdoor unit 121 and the indoor unit model code 0x2D of the indoor unit 112 coupled to the outdoor unit 121, the cloud platform 31 looks up a piece of scenario data corresponding to the outdoor unit model code 0x16 and the indoor unit model code 0x2D in the scenario data table. For example, a piece of scenario data $B_{34}$ corresponding to the outdoor unit model code 0x16 and the indoor unit model code 0x2D will be looked up in Table 1, and the piece of scenario data $B_{34}$ is "$M_1$, Me". That is, the piece of scenario data $B_3$ includes the scenario $M_1$ and the scenario Me. Therefore, the scenarios corresponding to the outdoor unit 121 and the indoor unit 112 coupled to the outdoor unit 121 include the scenario $M_1$ and the scenario Me.

Therefore, in a case where the server 30 obtains the outdoor unit model code of the outdoor unit 12 and the indoor unit model code of the indoor unit 11 coupled to the outdoor unit 12, a piece of scenario data corresponding to the matching of the outdoor unit model code of the outdoor unit 12 and the indoor unit model code of the indoor unit 11 may be obtained according to the scenario data table. The piece of scenario data corresponds to at least one scenario corresponding to the matching of the outdoor unit 12 and the indoor unit 11. In this way, the air conditioning system 1 provided by some embodiments of the present disclosure may obtain a plurality of scenarios corresponding to the matching of different outdoor units 12 and different indoor units 11, thereby realizing dynamic adaptation of the scenarios of the air conditioner 10 and facilitating control of different scenarios.

For example, the server 30 (e.g., the cloud platform 31) may further update the scenario data table. For example, the server 30 may update indoor unit model code(s), outdoor unit model code(s) and piece(s) of scenario data in the scenario data table. For example, after the cloud platform 31 obtains an outdoor unit model code of an outdoor unit 12 and an indoor unit model code of an indoor unit 11 coupled to the outdoor unit, a piece of scenario data corresponding to the outdoor unit model code of the outdoor unit 12 and the indoor unit model code of the indoor unit 11 may not be looked up in the scenario data table pre-stored in the server 30. For example, the indoor unit model code of the indoor unit 11 does not exist in the scenario data table, the outdoor unit model code of the outdoor unit 12 does not exist in the scenario data table, or the outdoor unit model code of the outdoor unit 12 and the indoor unit model code of the indoor unit 11 do not exist in the scenario data table.

In a case where the indoor unit model code of the indoor unit 11 does not exist in the scenario data table, the cloud platform 31 may update the indoor unit model code of the indoor unit 11 into the scenario data table and simultaneously update a piece of scenario data corresponding to the indoor unit model code of the indoor unit 11 and each outdoor unit model code (including the outdoor unit model code of the outdoor unit 12) into the scenario data table.

In a case where the outdoor unit model code of the outdoor unit 12 does not exist in the scenario data table, the cloud platform 31 may update the outdoor unit model code of the outdoor unit 12 into the scenario data table and simultaneously update a piece of scenario data corresponding to the outdoor unit model code of the outdoor unit 12 and each indoor unit model code (including the indoor unit model code of the indoor unit 11) into the scenario data table.

In a case where the outdoor unit model code of the outdoor unit 12 and the indoor unit model code of the indoor unit 11 do not exist in the scenario data table, the cloud platform 31 may update the indoor unit model code of the indoor unit 11 and the outdoor unit model code of the outdoor unit 12 into the scenario data table, update a piece of scenario data corresponding to the outdoor unit model code of the outdoor unit 12 and each indoor unit model code (including the indoor unit model code of the indoor unit 11) into the scenario data table, and update a piece of scenario data corresponding to the indoor unit model code of the indoor unit 11 and each outdoor unit model code (including the outdoor unit model code of the outdoor unit 12) into the scenario data table.

In step 35, the terminal device 40 obtains the piece of scenario data and outputs the scenario(s) corresponding to the piece of scenario data.

After the server 30 (e.g., the cloud platform 31) has looked up the piece of scenario data corresponding to the outdoor unit 12 and the indoor unit 11 coupled to the outdoor unit 12, the server 30 may send the piece of scenario data to the terminal device 40. For example, the server 30 may send the piece of scenario data to the APP 41 installed on the terminal device 40, and the APP 41 obtains the piece of scenario data and outputs the scenario(s) corresponding to the piece of scenario data.

A process of outputting the scenario(s) by the terminal device 40 will be illustrated in the following embodiments by considering the APP 41 as an example.

For example, the APP 41 may output a control interface corresponding to each scenario in the piece of scenario data, so as to allow the user to perform relevant control. For example, each scenario in the piece of scenario data may correspond to a control interface, and the APP 41 may switch control interfaces corresponding to different scenarios, so as to realize switching between different scenarios.

Figure 4:
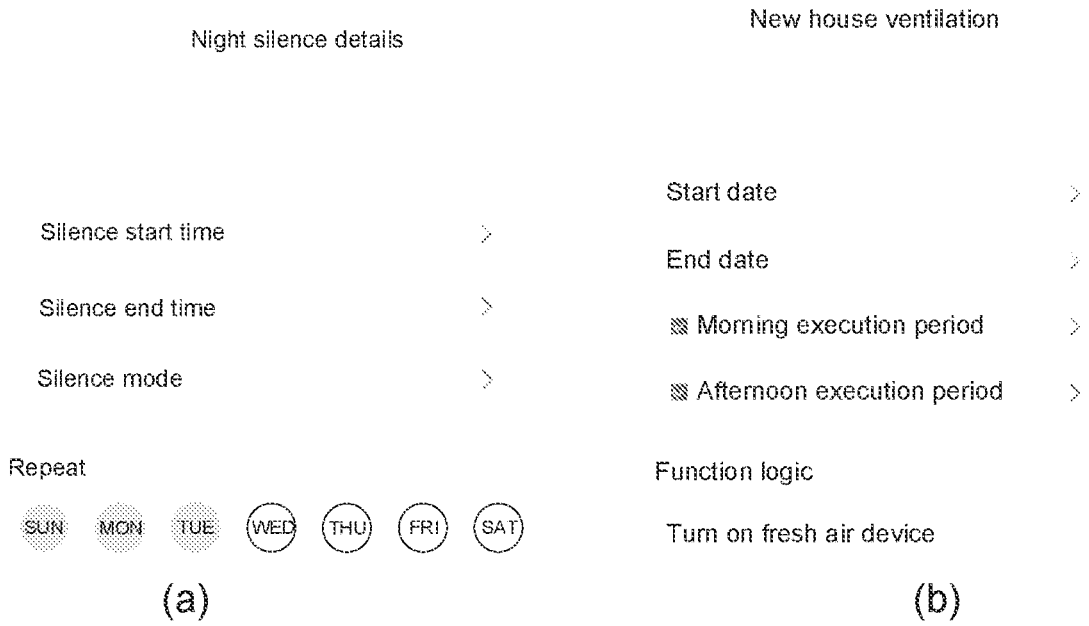
FIG. 4 is a schematic diagram of control interfaces corresponding to different scenarios, in accordance with some embodiments.

FIG. 4 is a schematic diagram of control interfaces corresponding to different scenarios, in accordance with some embodiments, where (a) in FIG. 4 is a schematic diagram of a control interface corresponding to the night silence scenario, and (b) in FIG. 4 is a schematic diagram of a control interface corresponding to a new house ventilation scenario.

For example, when the environment in which the user is located needs to keep quiet, the night silence scenario may be enabled to turn on a silence mode of the air conditioner 10. In the silence mode, the air conditioner 10 will control the rotational speed of the fan to decrease, so as to reduce the noise output of the air conditioner 10 by sacrificing a certain cooling or heating efficiency. The user may set related functions on the control interface corresponding to the night silence scenario. For example, as shown in (a) in FIG. 4, the user may set a silence start time, a silence end time, and repetition of the silence mode within a week (Monday to Sunday).

For another example, when a new house into which the user moves needs ventilation, the new house ventilation scenario may be enabled to turn on a fresh air device of the air conditioner 10 and operate a ventilation mode. In the ventilation mode, the air conditioner 10 turns off the compressor and introduces outdoor fresh air into the room and simultaneously discharges the indoor dirty air to the outside by adjusting a circulation manner of the indoor air or the rotational speed of the fan. The user may set related functions on the control interface corresponding to the new house ventilation scenario. For example, as shown in (b) in FIG. 4, the user may set a start date, an end date, a morning execution period, and an afternoon execution period for turning on the fresh air device.

For example, the user may add device information of the gateway device 20 in the APP 41 and look up the respective operating information of both the plurality of indoor units 11 and the plurality of outdoor units 12 coupled to the gateway device 20 in the APP 41 according to the device information of the gateway device 20. For example, the air conditioning system 1 includes a plurality of gateway devices 20. At least one group may be set in the APP 41 (e.g., each group may include a plurality of users), and device information of at least one gateway device 20 (e.g., a device code of the gateway device 20) may be added to each group. The APP 41 may take each group as a unit to obtain device information of the plurality of gateway device 20 in the at least one group and a scenario list corresponding to the plurality of outdoor units coupled to the plurality of gateway devices 20 and the plurality of indoor units coupled to the plurality of outdoor units. The scenario list includes at least one scenario, and the APP 41 may output a control interface corresponding to each scenario in the scenario list.

In some embodiments, each scenario corresponding to a piece of scenario data has a scenario marker-position-information. The terminal device 40 obtaining the piece of scenario data and outputting the scenario(s) corresponding to the piece of scenario data includes that the terminal device 40 obtains a scenario marker-position-information of each scenario corresponding to the piece of scenario data and outputs the scenario(s) corresponding to the scenario marker-position-information(s) according to the scenario marker-position-information(s).

For example, the cloud platform 31 in the server 30 sets a scenarios flag $S_x$ for each scenario $M_x$ represented by each piece of scenario data in the scenario data table. The APP 41 on the terminal device 40 may obtain the scenario(s) corresponding to the outdoor unit 12 and the indoor unit 11 coupled to the outdoor unit 12 by obtaining the scenario marker-position-information(s) of the scenario(s) corresponding to the outdoor unit 12 and the indoor unit 11 coupled to the outdoor unit 12, and then the APP 41 may output the scenario(s). Setting the scenario marker-position-information may further improve the efficiency of the APP 41 obtaining the scenario corresponding to the outdoor unit 12 and the indoor unit 11 coupled the outdoor unit 12.

It will be noted that the cloud platform 31 may further set a scenario marker-position-information set U for each piece of scenario data in the scenario data table. The scenario marker-position-information set U corresponds to a scenario set S, the scenario marker-position-information set U includes at least one scenario marker-position-information $S_x$, and the scenario set S includes the scenario(s) $M_x$ corresponding to the scenario marker-position-information(s) $S_x$.

Figure 1B:
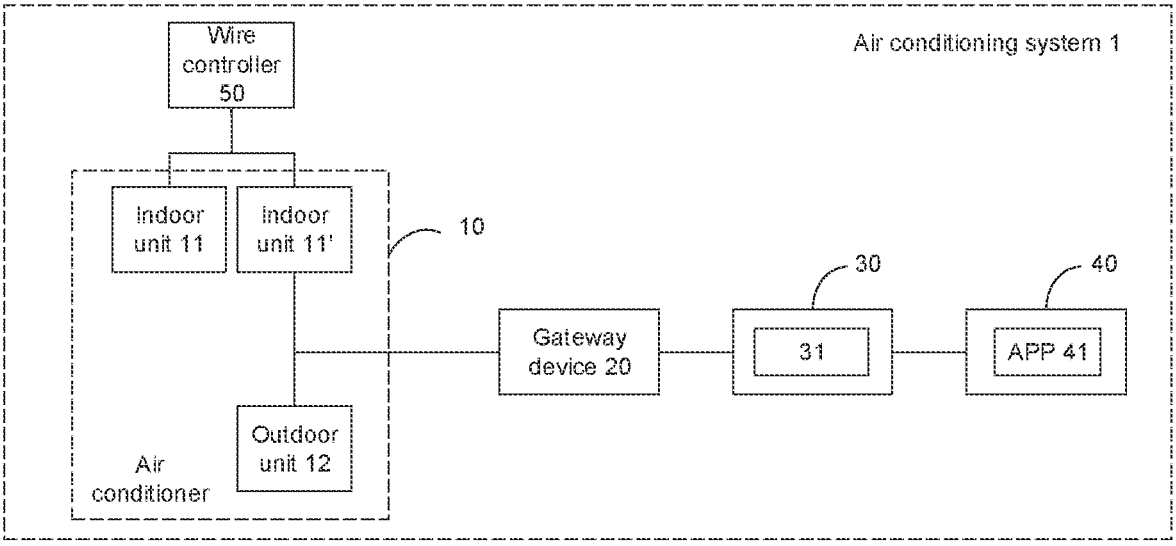
FIG. 1B is a block diagram of an air conditioning system, in accordance with some embodiments.

In some embodiments, as shown in FIG. 1B, the air conditioning system 1 further includes at least one wire controller 50 with an identification code (i.e., an identification bit), and each wire controller controls at least two indoor units to operate. For example, the wire controller 50 may control an indoor unit 11 and an indoor unit 11' to operate.

For example, the wire controller 50 may be a wireless wire controller with a communication device, such as a Wi-Fi wire controller. Alternatively, the wire controller 50 may be a wired wire controller without a communication device.

It will be noted that the wire controller 50 controlling the at least two indoor units to operate refers to that the wire controller 50 controls working states of all indoor units coupled to the wire controller 50. For example, the wire controller 50 may display a control interface of the working states of all the indoor units coupled thereto, and the user can control the working states of all the indoor units coupled to the wire controller 50 though the control interface.

In the air conditioning system, each indoor unit may have the same or different working states, which is not limited in the embodiments of the present disclosure. For example, the working states of the indoor unit may be related to the category of the indoor unit.

For example, referring to FIG. 2, in a case where the indoor unit model code of the indoor unit 111 coupled to the wire controller 51 and the indoor unit model code of the indoor unit 112 coupled to the wire controller 51 are different, the working states of the indoor unit 111 and the indoor unit 112 may be different. In this case, the wire controller 51 displays common working state(s) of the indoor unit 111 and the indoor unit 112. For example, the wire controller 51 displays an intersection of the working states of the indoor unit 111 and the indoor unit 112 that are coupled to wire controller 51. In this way, the user may control the working states of the at least two indoor units coupled to the wire controller 50 through the wire controller 50.

It will be noted that, in addition to controlling the working states of the indoor unit 11 and the indoor unit 11' that are coupled to the wire controller 50 through the wire controller 50, the user may also control the working states of the indoor unit 11 and the indoor unit 11' in the air conditioner 10 through the APP 41 on the terminal device 40.

The working states of each indoor unit in the air conditioner 10 may be displayed on the APP 41. For example, referring to FIG. 2, working states of the indoor unit 111 to an indoor unit 115 in the air conditioner 10 may be displayed on the APP 41, and the user may individually control the working states of each indoor unit through the APP 41, while the wire controller 51 implements control of an intersection of the working states of the indoor unit 111 and the indoor unit 112, and the wire controller 52 implements control of an intersection of the working states of the indoor unit 113 to the indoor unit 115.

In some examples, in a case where the working states of the at least two indoor units coupled to the wire controller 50 are not completely the same, working states of a certain indoor unit displayed on the APP 41 may be inconsistent with the working states of the certain indoor unit displayed on the wire controller 50. For example, referring to FIGS. 2 and 5, in a case where the working states of the indoor unit 111 coupled to the wire controller 51 include A, B, C and D, and the working states of the indoor unit 112 coupled to the wire controller 51 include A, B, C, D and E, the working states displayed on the wire controller 51 are an intersection of the working states of the indoor unit 111 and the indoor unit 112, that is, the intersection of A, B, C and D, while respective working states of the indoor unit 111 and the indoor unit 112 may be displayed on the APP 41. In this case, when the user sends a control instruction to enable the working state E of the indoor unit 112 through the APP 41, the control instruction cannot be responded to by the wire controller 51, thus resulting in failure to enable the working state E. The working state A, B, C, D, or E may represent any of working states of the indoor unit, the working states including power-on, power-off, cooling mode, heating mode, dehumidification mode, air volume adjustment, and additional functions (e.g., the above silence mode).

It will be noted that the cooling mode refers to an operating mode in which the air conditioner 10 lowers the indoor temperature below a set temperature when the air conditioner 10 is operating, and the cooling mode is usually used in summer. The heating mode refers to an operating mode in which the air conditioner 10 raises the indoor temperature above a set temperature when the air conditioner 10 is operating, and the heating mode is usually used in winter. The dehumidification mode refers to an operating mode in which the air conditioner 10 adjusts indoor humidity and lowers the indoor humidity below a preset threshold when the air conditioner 10 is operating, and the dehumidification mode is suitable for humid seasons or humid regions. The air volume adjustment refers to that when the air conditioner is operating, the rotational speed of the fan may be adjusted to increase or decrease the air supply volume.

In view of this, referring to FIG. 1B, in some embodiments, the server 30 is configured to obtain an identification code of at least one wire controller 50, obtain working state information of the plurality of indoor units coupled to the at least one wire controller 50 according to the identification code of the at least one wire controller 50, and obtain an intersection of the working state information of the plurality of indoor units coupled to the at least one wire controller 50 according to the working state information of the plurality of indoor units coupled to the at least one wire controller 50. The terminal device 40 is configured to obtain the intersection of the working state information of the plurality of indoor units and output the intersection of the working state information of the plurality of indoor units.

For example, the wire controller 50 has the identification code, which is used to identify an identity of the wire controller 50. For example, referring to FIG. 2, the wire controller 51 and the wire controller 52 have respective identification codes, the identification code of the wire controller 51 may be flag1, and the identification code of the wire controller 52 may be flag2. When the server 30 (e.g., the cloud platform 31) obtains flag1 and flag2, the server 30 may identify the wire controller 51 according to flag1 and identify the wire controller 52 according to flag2.

Considering the cloud platform 31 in the server 30 as an example, as shown in FIG. 1B, the cloud platform 31 obtains the working states of the plurality of indoor units coupled to the wire controller 50 after identifying the wire controller 50 according to the identification code. For example, the cloud platform 31 may obtain the identification code of the wire controller 50 and the working states of the plurality of indoor units coupled to the wire controller 50 through the gateway device 20.

For example, referring to FIG. 2, the gateway device 20 transmits the obtained identification code flag1 of the wire controller 51 and the identification code flag2 of the wire controller 52 to the cloud platform 31. The cloud platform 31 obtains the working states of the indoor unit 111 coupled to the wire controller 51 and the working states of the indoor unit 112 coupled to the wire controller 51 according to the identification code flag1 through the gateway device 20.

Figure 5:
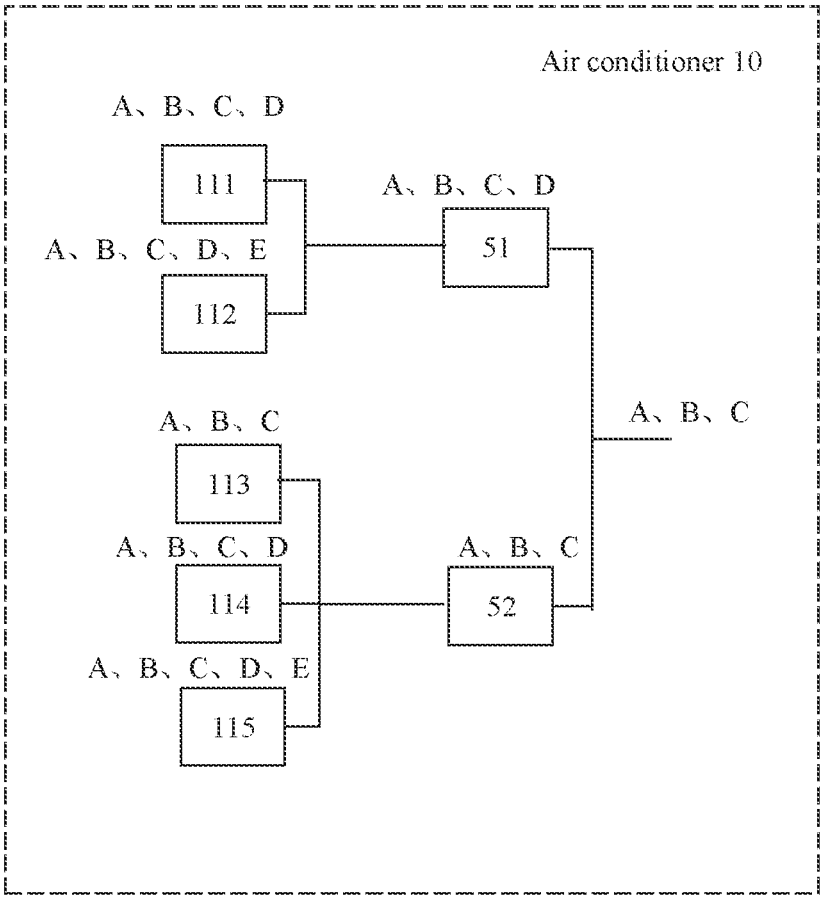
FIG. 5 is a schematic diagram of a working state of an air conditioner, in accordance with some embodiments.

As shown in FIG. 5, the working states of the indoor unit 111 include A, B, C and D and the working states of the indoor unit 111 may be recorded as a first working state set. The working states of the indoor unit 112 include A, B, C, D and E and the working states of the indoor unit 112 may be recorded as a second working state set.

The cloud platform 31 obtains the working states of the indoor unit 113 to the indoor unit 115 coupled to the wire controller 52 according to the identification code flag2 through the gateway device 20.

As shown in FIG. 5, the working states of the indoor unit 113 include A, B, and C and the working states of the indoor unit 113 may be recorded as a third working state set. The working states of the indoor unit 114 include A, B, C and D and the working states of the indoor unit 114 may be recorded as a fourth working state set. The working states of the indoor unit 115 include A, B, C, D and E and the working states of the indoor unit 115 may be recorded as a fifth working state set.

After the cloud platform 31 obtains the working states of the plurality of indoor units coupled to the at least one wire controller 50, the cloud platform 31 calculates the intersection of the working states of the plurality of indoor units according to the working states of the plurality of indoor units coupled to the at least one wire controller 50. It will be noted that the intersection of the working states of the plurality of indoor units refers to the intersection of the working states of the plurality of indoor units in the air conditioner 10, which is also referred to as working states of the air conditioner 10.

The cloud platform 31 may send the working states of the air conditioner 10 to the APP 41 on the terminal device 40 after obtaining the working states of the air conditioner 10. The APP 41 outputs the working states of the air conditioner 10 after obtaining the working states of the air conditioner 10. For example, the APP 41 may output the working states of the air conditioner 10 on the displaying control interface corresponding to the working states of the air conditioner 10.

By calculating the intersection of the working states of the plurality of indoor units in the air conditioner 10 and synchronizing the intersection of the working states to the APP 41, it may be ensured that the working states of each indoor unit on the APP 41 are consistent with the working states of each indoor unit on the wire controller 50. Therefore, it may avoid that the control instruction sent by the user through the APP 41 cannot be responded to by the wire controller 50, thereby avoiding issuing abnormal instruction, and improving user experience.

Figure 6:
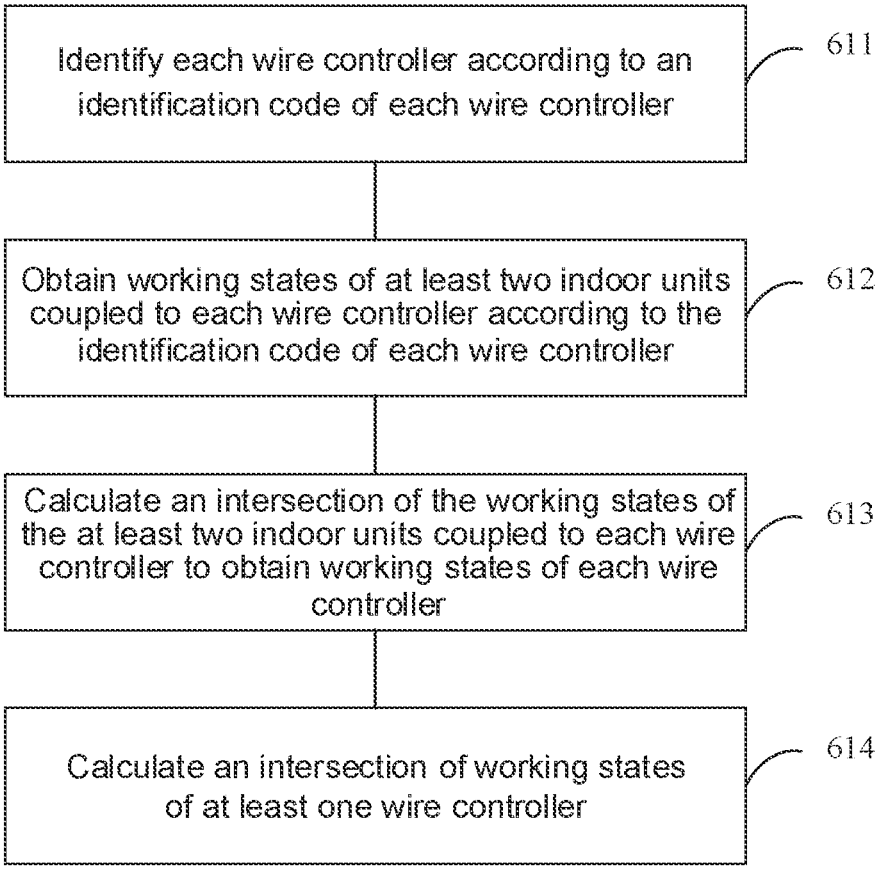
FIG. 6 is a flow diagram of a method for calculating a working state of an air conditioner, in accordance with some embodiments.
Figure 7:
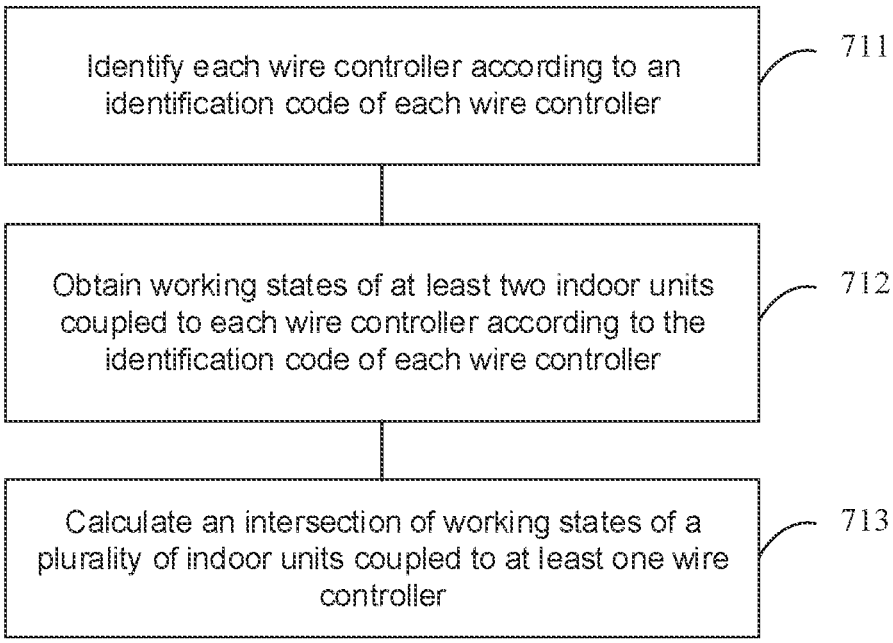
FIG. 7 is a flow diagram of another method for calculating a working state of an air conditioner, in accordance with some embodiments.

Referring to FIGS. 6 and 7, a process of the cloud platform 31 calculating the working states of the air conditioner 10 will be illustrated below.

In some examples, as shown in FIG. 6, the process of the cloud platform 31 calculating the working states of the air conditioner 10 includes steps 611 to 614.

In step 611, the cloud platform 31 identifies each wire controller according to the identification code of each wire controller.

For example, referring to FIG. 2, the cloud platform 31 may identify the wire controller 51 according to the obtained identification code flag1 and identify the wire controller 52 according to the identification code flag2.

In step 612, the cloud platform 31 obtains the working states of the at least two indoor units coupled to each wire controller according to the identification code of each wire controller.

For example, the step 612 includes a step 6121 and a step 6122.

In step 6121, the cloud platform 31 obtains the working states (i.e., the first working state set in the above example) of the indoor unit 111 coupled to the wire controller 51 and the working states (i.e., the second working state set in the above example) of the indoor unit 112 coupled to the wire controller 51 according to the identified wire controller 51.

In step 6122, the cloud platform 31 obtains the working states (i.e., the third working state set in the above example) of the indoor unit 113 coupled to the wire controller 52, the working states (i.e., the forth working state set in the above example) of the indoor unit 114 coupled to the wire controller 52, and the working states (i.e., the fifth working state set in the above example) of the indoor unit 115 coupled to the wire controller 52 according to the identified wire controller 52.

In step 613, the cloud platform 31 calculates an intersection of the working states of the at least two indoor units coupled to each wire controller to obtain the working states of each wire controller.

For example, the step 613 includes a step 6131 and a step 6132.

In step 6131, the cloud platform 31 calculates the intersection of the first working state set of the indoor unit 111 coupled to the wire controller 51 and the second working state set of the indoor unit 112 coupled to the wire controller 51 to obtain the working states (i.e., A, B, C, and D shown in FIG. 5) of the wire controller 51.

In step 6132, the cloud platform 31 calculates the intersection of the third working state set of the indoor unit 113 coupled to the wire controller 52, the fourth working state set of the indoor unit 114 coupled to the wire controller 52, and the fifth working state set of the indoor unit 115 coupled to the wire controller 52 to obtain the working states (i.e., A, B and C shown in FIG. 5) of the wire controller 52.

In step 614, the cloud platform 31 calculates an intersection of the working states of the at least one wire controller.

For example, with reference to FIG. 2, the cloud platform 31 calculates the intersection of the working states of the wire controller 51 and the wire controller 52 to obtain the working states of the air conditioner 10. As shown in FIG. 5, the working states of the air conditioner 10 are A, B and C.

The APP 41 obtains the working states of the air conditioner 10 obtained in the step 614 and outputs the working states of the air conditioner 10. For example, the APP 41 displays the working states of the air conditioner 10 on a control interface, so that the user may perform corresponding control.

In some other examples, as shown in FIG. 7, a process of the cloud platform 31 calculating the working states of the air conditioner 10 includes steps 711 to 713.

In step 711, the cloud platform 31 identifies each wire controller according to the identification code of each wire controller.

The step 711 is similar to the above step 611 and will not be repeated here.

In step 712, the cloud platform 31 obtains the working states of the at least two indoor units coupled to each wire controller according to the identification code of each wire controller.

The step 712 is similar to the above step 612 and will not be repeated here.

In step 713, the cloud platform 31 calculates an intersection of the working states of the plurality of indoor units coupled to the at least one wire controller.

The first working state set of the indoor unit 111 coupled to the wire controller 51, the second working state set of the indoor unit 112 coupled to the wire controller 51, and the third working state set of the indoor unit 113 coupled to the wire controller 52 to the fifth working state set of the indoor unit 115 coupled to the wire controller 52 may be obtained in step 712. The cloud platform 31 calculates the intersection of the working states of the indoor unit 111 to the indoor unit 115, that is, the cloud platform 31 calculates the intersection of the first working state set to the fifth working state set, so as to obtain the working states of the air conditioner 10. As shown in FIG. 5, the working states of the air conditioner 10 are A, B, and C.

The APP 41 obtains the working states of the air conditioner 10 obtained in the step 713 and outputs the working states of the air conditioner 10.

The air conditioning system 1 provided by some embodiments of the present disclosure may ensure that any working state on the control interface displayed by the APP 41 is included in the working states displayed by any wire controller 50. Therefore, it may be ensured that a control instruction, sent by the user through the APP 41, of any working state may be responded to by any wire controller 50, thereby realizing the control of the air conditioner 10 through the APP 41 and improving user experience.

For a multi-connected central air conditioning system, different outdoor units may be matched with different indoor units. Therefore, compatibility requirement for software installed on each device in the air conditioning system is relatively high. For example, the software installed on each device in the air conditioning system may be upgraded to improve the compatibility between the devices.

Figure 1C:
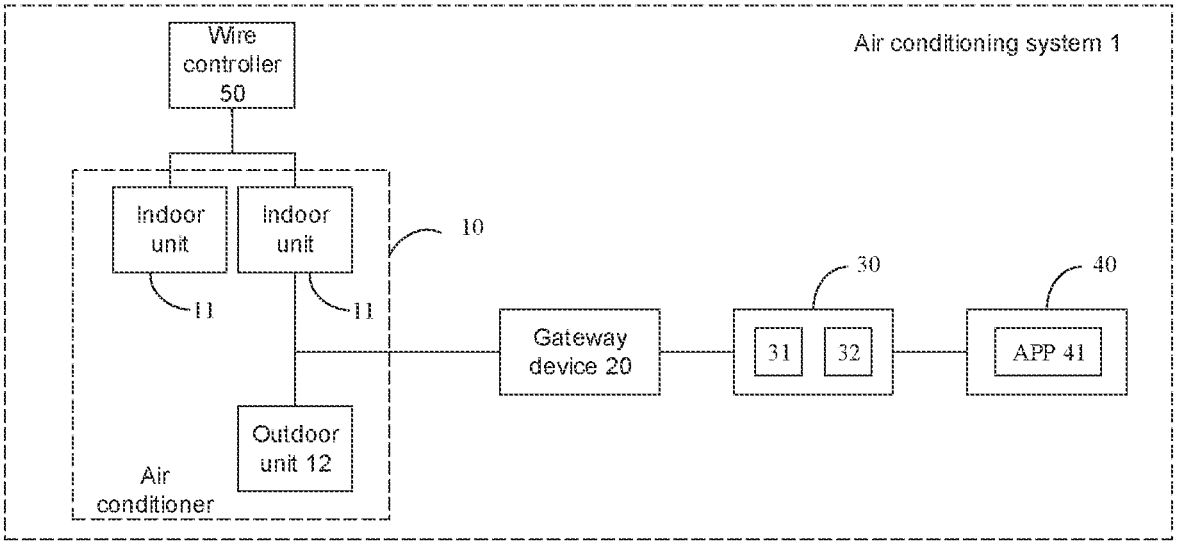
FIG. 1C is a block diagram of another air conditioning system, in accordance with some embodiments.

The air conditioning system 1 provided by some embodiments of the present disclosure may upgrade each device to be upgraded in the air conditioning system 1. As shown in FIG. 1C, each device to be upgraded in the air conditioning system 1 includes at least one of indoor units 11, an outdoor unit 12, a gateway device 20, and a wire controller 50. That is, the air conditioning system 1 may upgrade a device, that is, upgrade the indoor unit 11, the outdoor unit 12, the gateway device 20, or the wire controller 50. Alternatively, the air conditioning system 1 may upgrade a plurality of devices, that is, upgrade all of the indoor units 11, the outdoor unit 12, the gateway device 20, and the wire controller 50.

For example, the upgrade of the indoor unit 11 by the air conditioning system 1 may be an upgrade of software installed in a main control board of the indoor unit 11. The upgrade of the outdoor unit 12 by the air conditioning system 1 may be an upgrade of software installed in a main control board of the outdoor unit 12. The upgrade of the gateway device 20 by the air conditioning system 1 may be an upgrade of software installed in a main control chip of the gateway device 20. The upgrade of the wire controller 50 by the air conditioning system 1 may be an upgrade of software installed in a main control board of the wire controller 50.

In some embodiments, referring to FIG. 1C, the server 30 configures an upgrade package and an upgrade strategy for at least one device of the indoor units 11, the outdoor unit 12, the gateway device 20, and the wire controller 50 and sends the upgrade package and the upgrade strategy corresponding to the at least one device to the terminal device 40. The terminal device 40 receives the upgrade package and the upgrade strategy corresponding to the at least one device and uses the upgrade package to upgrade the at least one device according to the upgrade strategy.

For example, at least one device of the indoor units 11, the outdoor unit 12, the gateway device 20, and the wire controller 50 in the air conditioning system 1 may serve as a device to be upgraded.

For example, as shown in FIG. 1C, the server 30 further includes a management platform 32, and the management platform 32 may configure the corresponding upgrade package and upgrade strategy for each device to be upgraded in the air conditioning system 1. For example, the management platform 32 may be a World Wide Web (WEB) management platform, and the WEB management platform has an opened WEB port through which the WEB management platform may provide the upgrade package and the upgrade strategy for the device to be upgraded in the air conditioning system 1 for the terminal device 40 (e.g., the APP 41).

In some embodiments, the upgrade strategy includes a software identification number and a software version number of the device to be upgraded. The software identification number is used to indicate an identity of software that needs to be upgraded in the device to be upgraded, and the software version number includes a current software version number and a software version number to be upgraded.

In some examples, referring to FIG. 2, in a case where devices to be upgraded are the indoor unit 111 and the indoor unit 112, the management platform 32 configures respective upgrade packages and upgrade strategies for the indoor unit 111 and the indoor unit 112.

For example, referring to FIG. 2, the upgrade strategy configured by the management platform 32 for the indoor unit 111 may include a software identification number 00-00, a current software version number I-1001, and a software version upgrade from I-1001 to I-1002 (I-1001→I-1002), and the upgrade package configured for the indoor unit 111 may include an upgrade package with a software version number I-1002.

For another example, the upgrade strategy configured by the management platform 32 for the indoor unit 112 may include a software identification number 00-04, a current software version number I-100, and a software version upgrade from I-100 to I-101 (I-100→I-101), and the upgrade package configured for the indoor unit 112 may include an upgrade package with a software version number I-101.

In some examples, referring to FIG. 2, in a case where the gateway device 20, the wire controller 50, and the outdoor unit 121 and the outdoor unit 122 in the air conditioning system 1 are all to be upgraded, the management platform 32 may also configure corresponding upgrade packages and upgrade strategies for the gateway device 20, the wire controller 50, the outdoor unit 121, and the outdoor unit 122.

For example, the upgrade strategy configured by the management platform 32 for the gateway device 20 may include a software identification number 00-01, a current software version number C-100, and a software version upgrade from C-100 to C-101 (C-100→C-101), and the upgrade package configured for gateway device 20 may include an upgrade package with a software version number C-101.

For another example, the upgrade strategy configured by the management platform 32 for the wire controller 50 may include a software identification number 00-02, a current software version number X-100, and a software version upgrade from X-100 to X-101 (X-100→X-101), and the upgrade package configured for the wire controller 50 may include an upgrade package with a software version number X-101.

For yet another example, the upgrade strategy configured by the management platform 32 for the outdoor unit 121 may include a software identification number 00-03, a current software version number Q-100, and a software version upgrade from Q-100 to Q-101 (Q-100→Q-101), and the upgrade package configured for the outdoor unit 121 may include an upgrade package with a software version number Q-101.

For yet another example, the upgrade strategy configured by the management platform 32 for the outdoor unit 122 may include a software identification number 00-03', a current software version number Q-999, and a software version upgrade from Q-999 to Q-1001 (Q-999→Q-1001), and the upgrade package configured for the outdoor unit 122 may include an upgrade package with a software version number Q-1001.

After the management platform 32 completes the configuration of the upgrade package(s) and the upgrade strategy (strategies) for the device(s) to be upgraded in the air conditioning system 1, the upgrade package(s) and the upgrade strategy (strategies) may be sent to the APP 41. After receiving the upgrade package(s) and the upgrade strategy (strategies), the APP 41 uses the corresponding upgrade package(s) to upgrade the device(s) to be upgraded according to the contents of the upgrade strategy (strategies).

In some embodiments, the server 30 configures upgrade packages and upgrade strategies for a plurality of devices of the indoor units 11, the outdoor units 12, the gateway device 20, and the wire controllers 50 and sends the upgrade packages and the upgrade strategies corresponding to the plurality of devices to the terminal device 40. The terminal device 40 receives the upgrade packages and the upgrade strategies corresponding to the plurality of devices and upgrades the plurality of devices using the upgrade packages corresponding to the plurality of devices according to the upgrade strategies corresponding to the plurality of devices based on an upgrade order.

In a case where the devices to be upgraded in the air conditioning system 1 includes the plurality of devices, the terminal device 40 will upgrade the plurality of devices based on the upgrade order, and some embodiments of the present disclosure do not limit a manner of determining the upgrade order. For example, the upgrade order may be pre-stored in the cloud platform 31 and issued to the APP 41 by the cloud platform 31. For another example, the upgrade order may be pre-stored in the APP 41, and the APP 41 may upgrade the devices according to the pre-stored upgrade order when receiving the upgrade packages and the upgrade strategies corresponding to the plurality of devices.

For example, the terminal device 40 uses the upgrade packages corresponding to the plurality of devices to upgrade the plurality of devices according to the upgrade strategies corresponding to the plurality of devices based on an upgrade order of first upgrading the wire controller 50 and the gateway device 20 and then upgrades the indoor unit 11 and the outdoor unit 12.

In some examples, the terminal device 40 may upgrade the indoor unit 11 and the outdoor unit 12 after upgrading the wire controller 50 and the gateway device 20. For example, the terminal device 40 may first upgrade the wire controller 50, then upgrade the gateway device 20, and then upgrade the indoor unit 11 and outdoor unit 12. Alternatively, the terminal device 40 may first upgrade the gateway device 20, then upgrade the wire controller 50, and then upgrade the indoor unit 11 and the outdoor unit 12.

It will be noted that the upgrading process of the indoor unit 11 and the outdoor unit 12 needs to be implemented through the wire controller 50 or the gateway device 20. In this case, the wire controller 50 or the gateway device 20 needs to be upgraded first, and then the indoor unit 11 or the outdoor unit 12 will be upgraded after the upgrade of the wire controller 50 or the gateway device 20 is completed. Some embodiments of the present disclosure do not limit an upgrade order between the wire controller 50 and the gateway device 20 and an upgrade order between the indoor unit 11 and the outdoor unit 12.

For example, the APP 41 may upgrade the plurality of devices according to a priority order from the gateway device 20 to the wire controller 50 to the outdoor unit 12 and then to the indoor unit 11. Alternatively, the APP 41 may upgrade the plurality of devices according to a priority order from the wire controller 50 to the gateway device 20 to the outdoor unit 12 and then to the indoor unit 11. Alternatively, the APP 41 may upgrade the plurality of devices according to a priority order from the gateway device 20 to the wire controller 50 to the indoor unit 11 and then to the outdoor unit 12. Alternatively, the APP 41 may upgrade the plurality of devices according to a priority order from the wire controller 50 to the gateway device 20 to the indoor unit 11 and then to the outdoor unit 12.

It will be noted that some embodiments of the present disclosure do not limit an upgrade order between the same type of devices to be upgraded. For example, referring to FIG. 2, the outdoor unit 121 and the outdoor unit 122 both belong to a type of outdoor unit, and some embodiments of the present disclosure do not limit an upgrade order between the outdoor unit 121 and the outdoor unit 122 regardless of whether the outdoor unit 121 and the outdoor unit 122 are the same outdoor units. For example, in a case where the outdoor unit 121 and the outdoor unit 122 have different outdoor unit model codes (i.e., the outdoor unit 121 and the outdoor unit 122 are outdoor units with different models), the outdoor unit 121 may be upgraded first, and then the outdoor unit 122 may be upgraded; alternatively, the outdoor unit 122 may be upgraded first, and then the outdoor unit 121 may be upgraded.

In some embodiments of the present disclosure, the air conditioning system 1 sequentially upgrades the plurality of devices to be upgraded based on the upgrade order, thereby avoiding upgrade failure caused by confusion in the upgrade process and improving upgrade efficiency.

In some embodiments, the cloud platform 31 may store a device strategy data list List thereon. Referring to FIG. 1C, the device strategy data list List includes device information of the plurality of devices in the air conditioning system 1, and the plurality of devices may include the indoor units 11, the outdoor unit 12, the gateway device 20, and the wire controller 50. For example, the device strategy data list List includes at least a device identification Device_FLG, a device type Device_Type, an upgrade identification OTA_FLG, and an upgrade strategy list.

The device identification Device_FLG is used to identify the identity of each device in the air conditioning system 1. Each device has a device identification, and the device identification of each device is different from that of other devices. The device identification Device_FLG may be used to distinguish the identity of each device. For example, the device identification Device_FLG may be a device code or a device binding code, and the device binding code may include a two-dimensional code or the like.

The device type Device_Type is used to indicate the device types in the air conditioning system 1. For example, the device types may include a gateway device type, a wire controller type, an indoor unit type, and an outdoor unit type. The gateway device type may be recorded as Type 1, the wire controller type may be recorded as Type 2, the outdoor unit type may be recorded as Type 3, and the indoor unit type may be recorded as Type 4. Therefore, the device type Device_Type may include Type 1, Type 2, Type 3, and Type 4.

It will be noted that the device type Device_Type distinguishes different types of devices. For example, Type 1 represents the gateway device type instead of a certain gateway device 20. There may be a plurality of gateway devices 20 with different device identifications Device_FLG in Type 1.

The upgrade identification OTA_FLG is used to indicate whether a device in the air conditioning system 1 needs to be upgraded. The upgrade identification OTA_FLG may be set to 1 or 0. For example, if an upgrade identification OTA_FLG of a gateway device 20 is 1, it means that the gateway device 20 needs to be upgraded, and if an upgrade identification OTA_FLG of a gateway device 20 is 0, it means that the gateway device 20 does not need to be upgraded.

The upgrade strategy list is a collection of upgrade strategies of the plurality of devices to be upgraded in the air conditioning system 1. For example, the upgrade strategy list may include an upgrade strategy 1 and an upgrade strategy 2. The upgrade strategy 1 may be an upgrade strategy of the gateway device 20, and the upgrade strategy 2 may be an upgrade strategy of the wire controller 50.

For example, the device strategy data list List may further include a user confirmation identification Confirm_FLG and a strategy type Strategy_Type.

Each device in the air conditioning system 1 has a user confirmation identification Confirm_FLG, and an initial value of the user confirmation identification Confirm_FLG of each device may be 0. For example, when the user confirms that the gateway device 20 needs to be upgraded, the user may assign 1 to the user confirmation identification Confirm_FLG of the gateway device 20. When the user does not confirm that the gateway device 20 needs to be upgraded, the value of the user confirmation identification Confirm_FLG of the gateway device 20 is still 0.

The strategy type Strategy_Type is used to indicate an upgrade strategy of a certain device type, and the strategy type Strategy_Type corresponds to the device type Device_Type. For example, in a case where the device type Device_Type includes the gateway device type, the wire controller type, the indoor unit type, and the outdoor unit type, the corresponding strategy type Strategy_Type includes a gateway device strategy type, a wire controller strategy type, an indoor unit strategy type, and an outdoor unit strategy type. For example, the gateway device strategy type is recorded as Type 1', the wire controller strategy type is recorded as Type 2', the indoor unit strategy type is recorded as Type 3', and the outdoor unit strategy type is recorded as Type 4'. In this way, the strategy type Strategy_Type may include Type 1', Type 2', Type 3', and Type 4'.

Therefore, the cloud platform 31 (i.e., the server 30) manages and maintains the device strategy data list List and updates the device strategy data list List, so that the information and the update information of all the devices in the air conditioning system 1 may be obtained clearly and quickly.

For example, the cloud platform may further store thereon device lists Device_List of the devices to be upgraded in the air conditioning system 1, and each device to be upgraded in the air conditioning system 1 has a device list Device_List. The device list Device_List may be filtered out according to the upgrade identification OTA_FLG in the device strategy data list List. For example, relevant information of devices of which upgrade identifications OTA_FLG are 0 is filtered out from the device strategy data list List, so as to obtain relevant information of devices of which upgrade identifications OTA_FLG are 1.

The device list Device_List may include the relevant information of the devices of which upgrade identifications OTA_FLG are 1 filtered out from the device strategy data list List. For example, the relevant information includes the upgrade identification OTA_FLG, the user confirmation identification Confirm_FLG and the strategy type Strategy_Type, and may further include a popup identification Popup_FLG, a strategy identification OTA_ID and a strategy description OTA_DESC.

The popup identification Popup_FLG displays relevant prompt information for the user in a form of popping up a window. For example, the popup identification Popup_FLG may be used to prompt the user with upgrade information of a certain device in the air conditioning system 1 in the form of popping up a window on the APP 41. An initial value of the popup identification Popup_FLG may be 0. If a popup window appears on the APP 41 to prompt upgrade of a certain device (e.g., the gateway device 20), a value of 1 will be assigned to the popup identification Popup_FLG in the device list Device_List of the device, otherwise the popup identification Popup_FLG maintains the initial value of 0.

For example, before each device to be upgraded is upgraded, prompt information, such as a popup window for the user to choose the upgrade situation (e.g., not upgrade temporarily or upgrade immediately), may be displayed on the APP 41 in the form of popping up a window, so as to improve user experience.

The strategy identification OTA_ID is used to identify an identity of a strategy. For example, the strategy identification OTA_ID of the gateway device 20 is used to identify the upgrade strategy of the gateway device 20, and the strategy identification OTA_ID of the wire controller 50 is used to identify the upgrade strategy of the wire controller 50.

The strategy description OTA_DESC may include a textual description of the contents of the upgrade strategy.

In FIG. 2, the devices to be upgraded in the air conditioning system 1 include the indoor unit 111, the gateway device 20, and the outdoor unit 121. A device list Device_List of the indoor unit 111 may include an upgrade identification OTA_FLG, a strategy identification OTA_ID, and a strategy description OTA_DESC. For example, the upgrade identification OTA_FLG may be 1, the strategy identification OTA_ID may be 10000, and the strategy description OTA_DESC may be that the indoor unit 111 is being upgraded, and the indoor unit 111 is upgraded from a current software version number I-1001 to a software version number I-1002.

For example, a device list Device_List of the gateway device 20 includes an upgrade identification OTA_FLG, a strategy identification OTA_ID, and a strategy description OTA_DESC. For example, the upgrade identification OTA_FLG may be 1, the strategy identification OTA_ID may be 20000, and the strategy description OTA_DESC may be that the gateway device 20 is being upgraded, and the gateway device 20 is upgraded from a current software version number C-100 to a software version number C-101.

For example, a device list Device_List of the outdoor unit 121 includes an upgrade identification OTA_FLG, a strategy identification OTA_ID, and a strategy description OTA_DESC. For example, the upgrade identification OTA_FLG may be 1, the strategy identification OTA_ID may be 30000, and the strategy description OTA_DESC may be that the outdoor unit 121 is being upgraded, and the outdoor unit 121 is upgraded from a current software version number 0-100 to a software version number 0-101.

For example, the cloud platform 31 traverses the device lists Device_List of all devices to be upgraded in the air conditioning system 1 and integrates the strategy descriptions OTA_DESC corresponding to different strategy identifications OTA_ID, so as to obtain a strategy file of the air conditioning system 1.

For example, the cloud platform 31 may determine the upgrade order of the devices to be upgraded in the air conditioning system 1 according to the strategy identifications OTA_ID and integrate the strategy descriptions OTA_DESC in the device lists Device_List of the devices to be upgraded based on the upgrade order. For example, referring to FIG. 1C, the upgrade order, obtained by the cloud platform 31 according to the strategy identifications OTA_ID, of the devices in the air conditioning system 1 is from the gateway device 20, to the wire controller 50, to the outdoor unit 12, and to the indoor unit 11, and then the cloud platform 31 integrates the strategy descriptions OTA_DESC in the device lists Device_List corresponding to the gateway device 20, the wire controller 50, the outdoor unit 12, and the indoor unit 11 according to the order of the gateway device 20, the wire controller 50, the outdoor unit 12, and the indoor unit 11, so as to obtain the strategy file.

As described in the above example, the cloud platform 31 may integrate the strategy descriptions OTA_DESC of the gateway device 20, the outdoor unit 121, and the indoor unit 111 in the order of the gateway device 20, the outdoor unit 121, and the indoor unit 111. For example, the strategy file of the air conditioning system 1 is as follows: the gateway device 20 is being upgraded, and the gateway device 20 is upgraded from a current software version number C-100 to a software version number C-101; the outdoor unit 121 is being upgraded, and the outdoor unit 121 is upgraded from a current software version number Q-100 to a software version number Q-101; and the indoor unit 111 is being upgraded, and the indoor unit 111 is upgraded from a current software version number I-1001 to a software version number I-1002.

For example, the strategy file may further include matters needing attention for prompting the user during the upgrade. For example, the matters needing attention during the upgrade include suspending the service of APP 41 during the upgrade, so as to remind the user not to operate APP 41 during the upgrade. The strategy file may further include a prompt for the user about an approximate time required for the upgrade process. For example, the time for the upgrade process may be a time it takes for all the devices to be upgraded to complete the upgrade. Prompting the time for the upgrade process may facilitate the user to arrange the time reasonably.

Therefore, in the above example, the strategy file of the air conditioning system 1 may also be expressed as follows:

(a) The gateway device 20 is being upgraded, and the gateway device 20 is upgraded from a current software version number C-100 to a software version number C-101; the outdoor unit 121 is being upgraded, and the outdoor unit 121 is upgraded from a current software version number Q-100 to a software version number Q-101; the indoor unit 111 is being upgraded, and the indoor unit 111 is upgraded from a current software version number I-1001 to a software version number I-1002.

(b) This upgrade process will suspend the APP service.

(c) This upgrade process will take about N minutes.

For example, the cloud platform 31 may issue the above strategy file to the APP 41, and the APP 41 outputs the strategy file. For example, the APP 41 may output the strategy file in the form of popping up a window before each device to be upgraded is upgraded.

In some embodiments, the server 30 is further configured to, before at least one device of the indoor units 11, the outdoor units 12, the gateway device 20, and the wire controllers 50 is upgraded, control the terminal device 40 to display upgrade information of the at least one device. The upgrade information includes an upgrade strategy and upgrade prompt information of the at least one device, and the upgrade prompt information includes the time required for completing the upgrade of the at least one device.

For example, the terminal device 40 (e.g., the APP 41) may output the upgrade information by outputting an upgrade interface of each device to be upgraded. Each device to be upgraded has an upgrade interface. The upgrade interface may include the upgrade information of the corresponding device to be upgraded, and the upgrade information may include the upgrade strategy and prompt information during the upgrade process, that is, the upgrade information is the strategy file.

In some examples, the APP 41 may sequentially output the upgrade interfaces for all devices to be upgraded based on the upgrade order of all the devices to be upgraded in a form of popping up a window until all the devices to be upgraded are upgraded.

For example, when the indoor unit 111 is upgraded, the upgrade interface displayed on the APP 41 may include the following upgrade information (i.e., the strategy file):

a software identification number is 00-00, a current software version number is I-1001, a software version upgrade is from I-1001 to I-1002 (I-1001→I-1002), a configured upgrade package may include the upgrade package with the software version number I-1002, and the indoor unit 111 is being upgraded, the indoor unit 111 is upgraded from the current software version number I-1001 to the software version number I-1002, the upgrade process will suspend the APP service, and the upgrade process will take about N minutes.

For example, the upgrade interface may be displayed in the form of popping up a window. For example, the upgrade interface may include popup window options of "not upgrading temporarily" and "upgrading immediately". After the user clicks the "upgrade immediately," a value of 1 is assigned to the user confirmation identification Confirm_FLG, and the indoor unit 111 is upgraded. Otherwise, the indoor unit 111 is not upgraded temporarily.

Some embodiments of the present disclosure provide an air conditioning system, and the air conditioning system may be the air conditioning system in any of the above embodiments, such as the air conditioning system 1 in FIG. 1A. The air conditioning system includes a plurality of indoor units 11, a plurality of outdoor units 12, a gateway device 20, a server 30, and a terminal device 40. Each outdoor unit 12 is coupled to at least one indoor unit 11.

The gateway device 20 is coupled to the plurality of outdoor units 12 and the plurality of indoor units 11 and is configured to obtain first category identification information of each outdoor unit 12 and second category identification information of each indoor unit 11 and send the first category identification information and the second category identification information to the server 30.

The server 30 is configured to receive the first category identification information and the second category identification information sent by the gateway device 20, generate a scenario data table according to the first category identification information and the second category identification information, and store the scenario data table. The scenario data table includes a plurality of pieces of scenario data corresponding to the plurality of indoor units and the plurality of outdoor units, and each piece of scenario data corresponds to at least one scenario.

The terminal device 40 is coupled to the server 30 and configured to obtain the piece of scenario data and output scenario(s) corresponding to the piece of scenario data.

In some embodiments, as shown in FIG. 1A, the gateway device 20 is further configured to obtain first category identification information of a target outdoor unit and second category identification information of a target indoor unit coupled to the target outdoor unit and send the first category identification information and the second category identification information to the server 30. The server 30 is further configured to receive the first category identification information and the second category identification information send by the gateway device 20 and look up in the scenario data table, according to the first category identification information and the second category identification, information to determine a piece of target scenario data corresponding to the target outdoor unit and the target indoor unit. The terminal device 40 is further configured to obtain the piece of target scenario data and output scenario(s) corresponding to the piece of target scenario data.

In some embodiments, as shown in FIG. 1A, the server 30 is further configured to configure a scenario marker-position-information for each scenario corresponding to each piece of scenario data in the scenario data table. The terminal device 40 is further configured to obtain the scenario marker-position-information of each scenario corresponding to the piece of target scenario data and output a scenario corresponding to the scenario marker-position-information according to the scenario marker-position-information.

In some embodiments, as shown in FIG. 1B, the air conditioning system further includes at least one wire controller 50 with an identification code, and each wire controller 50 is coupled to at least two indoor units. The wire controller 50 is configured to control the at least two indoor units to operate. The server 30 is further configured to obtain an identification code of each wire controller 50, obtain working state information of the at least two indoor units coupled to each wire controller 50 according to the identification code of each wire controller 50, and obtain an intersection of working state information of the plurality of indoor units coupled to the at least one wire controller 50 according to the working state information of the plurality of indoor unit coupled to the at least one wire controller 50. The terminal device 40 is further configured to obtain the intersection of the working state information of the plurality of indoor units and output the intersection of working state information of the plurality of indoor units.

In some embodiments, as shown in FIG. 1B, the server 30 is further configured to obtain working state information corresponding to each wire controller 50 according to the working state information of the at least two indoor units coupled to each wire controller 50 and obtain the intersection of the working state information of the plurality of indoor units according to working state information corresponding to the at least one controller 50.

In some embodiments, as shown in FIG. 1C, the server 30 is further configured to configure an upgrade package and an upgrade strategy for at least one device of the indoor units 11, the outdoor unit 12, the gateway device 20, and the wire controller 50, and send the upgrade package and the upgrade strategy corresponding to the at least one device to the terminal device 40. The terminal device 40 is further configured to receive the upgrade package and the upgrade strategy corresponding to the at least one device and use the upgrade package to upgrade the at least one device according to the upgrade strategy.

In some embodiments, as shown in FIG. 1C, the server 30 is further configured to configure upgrade packages and upgrade strategies for a plurality of devices of the indoor units 11, the outdoor unit 12, the gateway device 20, and the wire controller 50 and send the upgrade packages and the upgrade strategies corresponding to the plurality of devices to the terminal device 40. The terminal device 40 is further configured to receive the upgrade packages and the upgrade strategies corresponding to the plurality of devices and upgrade the plurality of devices using the upgrade packages corresponding to the plurality of devices according to the upgrade strategies corresponding to the plurality of devices based on an upgrade order.

In some embodiments, as shown in FIG. 1C, the terminal device 40 is further configured to use the upgrade packages corresponding to the plurality of devices to upgrade the plurality of devices according to the upgrade strategies corresponding to the plurality of devices based on an upgrade order of first upgrading the wire controller 50 and the gateway device 20, and then upgrade the indoor unit 11 and the outdoor unit 12.

In some embodiments, as shown in FIG. 1C, the server 30 is further configured to, before the at least one device of the indoor units 11, the outdoor unit 12, the gateway device 20, and the wire controller 50 is upgraded, control the terminal device 40 to display upgrade information of the at least one device. The upgrade information includes an upgrade strategy of the at least one device and upgrade prompt information of the at least one device, and the upgrade prompt information includes a time required for completing the upgrade of the at least one device.

The beneficial effects of the air conditioning system are same as the beneficial effects of the method for controlling the air conditioning system as described in the above embodiments, and details will not be repeated here.

It will be noted that the steps described in a specific order in the drawings of some embodiments of the present disclosure do not require or imply that these steps must be performed in this specific order, or that all the shown steps must be performed to achieve the desired result. Additional content may be added to each step in the drawings, or some steps may be omitted, or a plurality of steps may be combined into one step for execution, or one step may be decomposed into a plurality of steps for execution, etc.

Some embodiments of the present disclosure provide a computer-readable storage medium (e.g., a non-transitory computer-readable storage medium), on which a computer program (including computer program instructions) is stored. When executed by an air conditioning system, the computer program causes the air conditioning system to perform the method for controlling the air conditioning system as described in any of the above embodiments.

For example, the computer-readable storage medium may include, but is not limited to a magnetic storage device (e.g., a hard disk, a floppy disk, or a magnetic tape), an optical disk (e.g., a compact disk (CD), or a digital versatile disk (DVD)), a smart card, and a flash memory device (e.g., an erasable programmable read-only memory (EPROM), a card, a stick or a key drive). The various computer-readable storage media described in the present disclosure may represent one or more devices and/or other machine-readable storage media for storing information.

Some embodiments of the present disclosure further provide a computer program product. The computer program product includes a computer program stored on the non-transitory computer-readable storage medium. When executed by the air conditioning system, the computer program causes the air conditioning system to perform the method for controlling the air conditioning system as described in the above embodiments.

Some embodiments of the present disclosure provide a computer program. When executed by the air conditioning system, the computer program causes the air conditioning system to perform the method for controlling the air conditioning system as described in the above embodiments.

Beneficial effects of the computer-readable storage medium, the computer program product, and the computer program are same as the beneficial effects of the method for controlling the air conditioning system as described in some embodiments described above, and details will not be repeated here.

The foregoing descriptions are merely specific implementations of the present disclosure, but the protection scope of the present disclosure is not limited thereto. Changes or replacements that any person skilled in the art could conceive of within the technical scope of the present disclosure shall be included in the protection scope of the present disclosure. Therefore, the protection scope of the present disclosure shall be subject to the protection scope of the claims.

What is claimed is:

1. A method for controlling an air conditioning system, the air conditioning system including:

a plurality of indoor units;

a plurality of outdoor units;

a gateway device configured to obtain first category identification information of an outdoor unit and second category identification information of an indoor unit coupled to the outdoor unit, and send the first category identification information and the second category identification information to a server;

the server configured to determine a piece of scenario data corresponding to the indoor unit and the outdoor unit according to the first category identification information, the second category identification information, and a scenario data table and output the piece of scenario data to a terminal device; and the terminal device configured to output at least one scenario corresponding to the piece of scenario data; and the method comprising:

an information collecting step configured to obtain, by the gateway device, the first category identification information of the outdoor unit, and the second category identification information of the indoor unit coupled to the outdoor unit;

an information transmitting step configured to send, by the gateway device, the first category identification information and the second category identification information to the server;

an information determining step configured to determine, by the server, the piece of scenario data corresponding to the outdoor unit and the indoor unit according to the first category identification information, the second category identification information, and the scenario data table, wherein the scenario data table includes a plurality of pieces of scenario data corresponding to the plurality of indoor units and the plurality of outdoor units, and each piece of scenario data corresponds to at least one scenario; and an information outputting step configured to output, by the server, the piece of scenario data to the terminal device, and output, by the terminal device, at least one scenario corresponding to the piece of scenario data.

2. The method according to claim 1, wherein each scenario corresponding to the piece of scenario data has a scenario marker-position-information; and the information outputting step is further configured to output, by the server, the scenario marker-position-information of each scenario corresponding to the piece of scenario data to the terminal device, and output, by the terminal device, the scenario corresponding to the scenario marker-position-information through the terminal device according to the scenario marker-position-information.

3. The method according to claim 1, wherein the first category identification information includes an outdoor unit model code, and the second category identification information includes an indoor unit model code; and the method further comprises:

a scenario data table updating step configured to update, by the server, indoor unit model codes, outdoor unit model codes, and pieces of scenario data in the scenario data table.

4. The method according to claim 1, wherein the air conditioning system further includes at least one wire controller having an identification code; each wire controller in the at least one wire controller is coupled to at least two indoor units in the plurality of indoor units and configured to control operations of the at least two indoor units; and the method further comprises:

an identification code obtaining step configured to obtain, by the server, an identification code of each wire controller;

a working state information obtaining step configured to obtain, by the server, working state information of the at least two indoor units coupled to each wire controller according to the identification code of each wire controller;

an intersection generating step configured to obtain, by the server, an intersection of working state information of the plurality of indoor units coupled to the at least one wire controller according to the working state information of the plurality of indoor units coupled to the at least one wire controller; and an intersection outputting step configured to obtain, by the terminal device, the intersection of the working state information of the plurality of indoor units, and output, by the terminal device, the intersection of the working state information of the plurality of indoor units.

5. The method according to claim 4, wherein the intersection generating step includes:

a first intersection generating sub-step configured to obtain, by the server, working state information corresponding to each wire controller according to the working state information of the at least two indoor units coupled to each wire controller; and a second intersection generating sub-step configured to obtain, by the server, the intersection of the working state information of the plurality of indoor units coupled to the at least one wire controller according to working state information corresponding to the at least one wire controller.

6. The method according to claim 4, further comprising:

an upgrade transmitting step configured to transmit, by the server, an upgrade package and an upgrade strategy corresponding to at least one device of the plurality of indoor units, the plurality of outdoor units, the gateway device, and the at least one wire controller to the terminal device;

an upgrade receiving step configured to receive, by the terminal device, the upgrade package and the upgrade strategy corresponding to the at least one device; and an upgrade executing step configured upgrade, by the terminal device, the at least one device using the upgrade package according to the upgrade strategy.

7. The method according to claim 6, wherein the upgrade transmitting step includes an upgrade transmitting sub-step, and the upgrade transmitting sub-step is configured to transmit, by the server, upgrade packages and upgrade strategies corresponding to a plurality of devices of the plurality of indoor units, the plurality of outdoor units, the gateway device, and the at least one wire control to the terminal device;

the upgrade receiving step includes an upgrade receiving sub-step, and the upgrade receiving sub-step is configured to receive, by the terminal device, the upgrade packages and the upgrade strategies corresponding to the plurality of devices; and the upgrade executing step includes an upgrade executing sub-step, and the upgrade executing sub-step is configured to upgrade, by the terminal device, the plurality of devices using the upgrade packages corresponding to the plurality of devices according to the upgrade strategies corresponding to the plurality of devices based on an upgrade order.

8. The method according to claim 7, wherein the upgrade executing sub-step is further configured to:

upgrade, by the terminal device, the plurality of devices using the upgrade packages corresponding to the plurality of devices according to the upgrade strategies corresponding to the plurality of devices based on the upgrade order of first upgrading a wire controller and the gateway device and then upgrading an indoor unit and an outdoor unit.

9. The method according to claim 6, further comprising:

an upgrade displaying step configured to control, by the server, the terminal device to display upgrade information before the server upgrades the at least one device of the plurality of indoor units, the plurality of outdoor units, the gateway device, and the at least one wire controller, wherein the upgrade information includes the upgrade strategy of the at least one device and upgrade prompt information of the at least one device, and the upgrade prompt information includes a time required to complete an upgrade of the at least one device.

10. A non-transitory computer-readable storage medium having stored thereon computer program instructions that, when executed by an air conditioning system, cause the air conditioning system to perform the method for controlling the air conditioning system according to claim 1.

11. An air conditioning system, comprising:

a plurality of indoor units;

a plurality of outdoor units, each outdoor unit in the plurality of outdoor units being coupled to at least one indoor unit in the plurality of indoor units;

a gateway device coupled to the plurality of outdoor units and the plurality of indoor units, and configured to obtain first category identification information of each outdoor unit and second category identification information of each indoor unit, and send the first category identification information and the second category identification information to a server;

the server coupled to the gateway device and configured to generate a scenario data table according to the first category identification information and the second category identification information and store the scenario data table, wherein the scenario data table includes a plurality of pieces of scenario data corresponding to the plurality of outdoor units and the plurality of outdoor units, and each piece of scenario data corresponds to at least one scenario; and a terminal device coupled to the server and configured to obtain a piece of scenario data and output at least one scenario corresponding to the piece of scenario data.

12. The air conditioning system according to claim 11, wherein the gateway device is further configured to obtain first category identification information of a target outdoor unit and second category identification information of a target indoor unit coupled to the target outdoor unit, and send the first category identification information of the target outdoor unit and the second category identification information of the target indoor unit to the server;

the server is further configured to receive the first category identification information, sent by the gateway device, of the target outdoor unit and the second category identification information, sent by the gateway device, of the target indoor unit, and obtain a piece of target scenario data corresponding to the target outdoor unit and the target indoor unit according to the first category identification information of the target outdoor unit, the second category identification information of the target indoor unit, and the scenario data table; and the terminal device is further configured to obtain the piece of target scenario data, and output at least one scenario corresponding to the piece of target scenario data.

13. The air conditioning system according to claim 12, wherein the server is further configured to configure a scenario marker-position-information for each scenario corresponding to each piece of scenario data in the scenario data table; and the terminal device is further configured to obtain a scenario marker-position-information of each scenario corresponding to the piece of target scenario data, and output a scenario according to the scenario marker-position-information of each scenario corresponding to the piece of target scenario data.

14. The air conditioning system according to claim 11, wherein the first category identification information includes an outdoor unit model code, and the second category identification information includes an indoor unit model code; and the server is further configured to update indoor unit model codes, outdoor unit model codes, and pieces of scenario data in the scenario data table.

15. The air conditioning system according to claim 11, further comprising:

at least one wire controller having an identification code; each wire controller in the at least one wire controller being coupled to at least two indoor units in the plurality of indoor units, and each wire controller being configured to control the at least two indoor units to operate, wherein the server is further configured to obtain an identification code of each wire controller, obtain working state information of the at least two indoor units coupled to each wire controller according to the identification code of each wire controller, and obtain an intersection of working state information of the plurality of indoor units coupled to the at least one wire controller according to the working state information of the plurality of indoor units coupled to the at least one wire controller, and the terminal device is further configured to obtain the intersection of the working state information of the plurality of indoor units and output the intersection of the working state information of the plurality of indoor units.

16. The air conditioning system according to claim 15, wherein the server is further configured to obtain working state information corresponding to each wire controller according to the working state information of the at least two indoor units coupled to each wire controller and obtain the intersection of the working state information of the plurality of indoor units coupled to the at least one wire controller according to working state information corresponding to the at least one wire controller.

17. The air conditioning system according to claim 15, wherein the server is further configured to configure an upgrade package and an upgrade strategy for at least one device of the plurality of indoor units, the plurality of outdoor units, the gateway device, and the at least one wire controller, and send the upgrade package and the upgrade strategy corresponding to the at least one device to the terminal device; and the terminal device is further configured to receive the upgrade package and the upgrade strategy corresponding to the at least one device and upgrade the at least one device using the upgrade package according to the upgrade strategy.

18. The air conditioning system according to claim 17, wherein the server is further configured to configure upgrade packages and upgrade strategies for a plurality of devices of the plurality of indoor units, the plurality of outdoor units, the gateway device, and the at least one wire controller and send the upgrade packages and the upgrade strategies corresponding to the plurality of devices to the terminal device; and the terminal device is further configured to receive the upgrade packages and the upgrade strategies corresponding to the plurality of devices and upgrade the plurality of devices using the upgrade packages corresponding to the plurality of devices according to the upgrade strategies corresponding to the plurality of devices based on an upgrade order.

19. The air conditioning system according to claim 18, wherein the terminal device is further configured to upgrade the plurality of devices using the upgrade packages corresponding to the plurality of devices according to the upgrade strategies corresponding to the plurality of devices based on the upgrade order of first upgrading a wire controller and the gateway device and then upgrading an indoor unit and an outdoor unit.

20. The air conditioning system according to claim 17, wherein the server is further configured to control the terminal device to display upgrade information before the server upgrades the at least one device of the plurality of indoor units, the plurality of outdoor units, the gateway device, and the at least one wire controller; the upgrade information including the upgrade strategy of the at least one device and upgrade prompt information of the at least one device, and the upgrade prompt information including a time required for completing an upgrade of the at least one device.

* * * * *